US009761939B2

(12) United States Patent
Pietila et al.

(10) Patent No.: US 9,761,939 B2
(45) Date of Patent: Sep. 12, 2017

(54) INTEGRATED LOW PROFILE PHASED ARRAY ANTENNA SYSTEM

(71) Applicant: The Boeing Company, Chicago, IL (US)

(72) Inventors: Douglas Allan Pietila, Puyallup, WA (US); David Lee Mohoric, Auburn, WA (US); Michael de La Chapelle, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 102 days.

(21) Appl. No.: 14/827,941

(22) Filed: Aug. 17, 2015

(65) Prior Publication Data

US 2017/0054208 A1 Feb. 23, 2017

(51) Int. Cl.

| | |
|---|---|
| ***H01Q 3/24*** | (2006.01) |
| ***H01Q 1/28*** | (2006.01) |
| ***H01Q 1/52*** | (2006.01) |
| ***H01Q 3/26*** | (2006.01) |
| ***H01Q 21/00*** | (2006.01) |
| ***H01Q 21/06*** | (2006.01) |
| ***H01Q 1/02*** | (2006.01) |

(52) U.S. Cl.

CPC ..... *H01Q 3/24* (2013.01); *H01Q 1/02* (2013.01); *H01Q 1/28* (2013.01); *H01Q 1/286* (2013.01); *H01Q 1/52* (2013.01); *H01Q 1/525* (2013.01); *H01Q 1/526* (2013.01); *H01Q 3/26* (2013.01); *H01Q 21/00* (2013.01); *H01Q 21/0025* (2013.01); *H01Q 21/06* (2013.01); *H01Q 21/061* (2013.01); *H01Q 21/064* (2013.01)

(58) Field of Classification Search

CPC ..... H01Q 3/24
USPC ..... 343/824
See application file for complete search history.

(56) References Cited

U.S. PATENT DOCUMENTS

| | | | | |
|---|---|---|---|---|
| 4,797,680 | A * | 1/1989 | Smethers, Jr. | H01Q 1/28 343/705 |
| 5,276,455 | A * | 1/1994 | Fitzsimmons | H01Q 21/0087 342/368 |
| 6,424,313 | B1 | 7/2002 | Navarro et al. | |
| 6,580,402 | B2 | 6/2003 | Navarro et al. | |
| 6,844,855 | B2 | 1/2005 | Carson | |
| 6,982,666 | B2 * | 1/2006 | Temes | F41H 11/12 342/179 |

(Continued)

FOREIGN PATENT DOCUMENTS

| | | | |
|---|---|---|---|
| DE | 10240494 | A1 | 9/2002 |
| JP | 2003287568 | A | 10/2003 |

(Continued)

OTHER PUBLICATIONS

Partial European Search Report, dated Jan. 10, 2017, regarding Application No. EP16184280.2, 10 pages.

(Continued)

*Primary Examiner* — Huedung Mancuso
(74) *Attorney, Agent, or Firm* — Yee & Associates, P.C.

(57) ABSTRACT

A phased array antenna for a mobile platform combines transmit and receive antennas within a common, low profile enclosure. Transmit and receive functions, a power supply, up and down frequency converters, and an antenna controller are integrated into closely packaged layers within the enclosure.

19 Claims, 22 Drawing Sheets

(56) References Cited

U.S. PATENT DOCUMENTS

| | | | | |
|---|---|---|---|---|
| 7,187,342 | B2 | 3/2007 | Heisen et al. | |
| 7,256,661 | B2 | 8/2007 | Chen et al. | |
| 7,274,336 | B2 | 9/2007 | Carson | |
| 7,287,987 | B2 | 10/2007 | Heisen et al. | |
| 7,495,521 | B2 | 2/2009 | Chen et al. | |
| 7,508,338 | B2 | 3/2009 | Pluymers et al. | |
| 7,889,127 | B2 | 2/2011 | Sajuyigbe et al. | |
| 8,081,134 | B2 | 12/2011 | Raby et al. | |
| 8,654,017 | B1 | 2/2014 | Voss et al. | |
| 9,472,843 | B2 * | 10/2016 | Takeuchi | H01Q 1/38 |
| 2003/0184476 | A1 * | 10/2003 | Sikina | H01Q 3/36 343/700 MS |
| 2009/0135085 | A1 | 5/2009 | Raby et al. | |
| 2009/0153426 | A1 * | 6/2009 | Worl | H01Q 21/0075 343/776 |
| 2011/0215985 | A1 * | 9/2011 | Kaplan | H01Q 21/08 343/879 |
| 2015/0130671 | A1 | 5/2015 | Cordone | |
| 2016/0211575 | A1 | 7/2016 | Tang et al. | |

FOREIGN PATENT DOCUMENTS

| | | | |
|---|---|---|---|
| JP | 2007201868 | A | 8/2007 |
| WO | 0219469 | A1 | 3/2002 |
| WO | WO2015042953 | A1 | 4/2015 |

OTHER PUBLICATIONS

Extended European Search Report, dated Feb. 28, 2017, regarding Application No. EP16184280.2, 15 pages.

* cited by examiner

INTEGRATED LOW PROFILE PHASED ARRAY ANTENNA SYSTEM

BACKGROUND INFORMATION

1. Field

The present disclosure generally relates to steerable communications antennas, and deals more particularly with a low-profile phased array antenna having a highly integrated architecture and a small form factor.

2. Background

A variety of steerable antenna systems are available for mobile platforms for RF (radio frequency) communication. Some steerable antenna systems, such as satellite communication (SATCOM) antennas used on aircraft, are required to have a low, aerodynamic profile and the ability to withstand wind loads and impacts such as bird strikes. One form of such antenna systems employs single axis or a 2-axis mechanical tracking mechanism that is housed within an RF transparent radome. These radomes have a relatively high profile and large footprint which add to aerodynamic drag, aircraft weight, complexity and maintenance costs. In addition, some of the mechanical tracking antennas mentioned above have certain operating limitations.

In order to overcome some of the problems discussed above, low profile phased array antenna systems have been developed which rely on electronic beam steering for satellite tracking, however these antenna systems also have certain drawbacks and are subject to improvement. For example, current "small form factor" phased array antenna systems for commercial aircraft comprise multiple functional units, referred to as LRU's (line replaceable units). The use of multiple LRU's and the need for related interconnecting cables, limit the form factor into which the system may be packaged. Moreover, the use of multiple LRU's and interconnecting cables result in higher hardware and integration costs.

Accordingly, there is a need for phased array antenna system that is highly integrated, minimizes the need for interconnection cables and has a smaller form factor to reduce its aerodynamic profile and space requirements.

SUMMARY

The disclosed embodiments provide a packaging architecture for a low profile, highly integrated, phased array antenna system that is particularly well-suited for mobile SATCOM applications, such as aircraft. Integration of multiple antenna system functions into a single unit reduces components and assemblies, while simplifying manufacturing. Separate transmit and receive apertures are packaged in close proximity to each other, thereby reducing the footprint of the antenna. A rectilinear aperture shaped is employed which allows more efficient use of space. The need for mechanical tracking mechanisms is eliminated through the use of electronic beam steering and near instantaneous beam-forming. Beam-forming, satellite tracking, power management, RF control, thermal management and built-in-test functions are integrated into a single unit.

The disclosed antenna system also provides enhanced signal conversion from either RF to IF or RF to baseband. The antenna system is well-suited to low-profile, low drag applications, and reduces the space required for installation while eliminating the need for a radome. Antenna functions previously requiring five separate LRUs and related interconnecting cables are combined into a single low profile unit. Transmit and receive functions, up and down converters, a power supply and an antenna controller are integrated and arranged in stacked physical layers within a low-profile chassis having RF isolation features that prevent interference between closely spaced transmit and receive antennas.

In one exemplary embodiment suitable for aeronautical SATCOM applications, the antenna system is adapted to provide dual simultaneous independently scanned receive beams, each with selectable polarization, including arbitrary linear, and left or right hand circular polarization. Each receive beam has selectable 500 MHz bandwidth over 2 GHz. Stacked receive IF (intermediate frequency) allows a single modem to switch between beams, bands and polarization. In one application, the integrated antenna enables simultaneous TV (television) and Internet connectivity, supporting dual independent simultaneous receive beams, and a single independent transmit beam, each with full polarization diversity. The antenna system may be mounted on aircraft using existing ARINC (aeronautical radio incorporated) mount locations and cable interfaces. The antenna system is readily scalable permitting integrated transmit and receive antennas of any desired size and/or shape, as well as operating frequencies.

According to one disclosed embodiment, a phased array antenna system is provided for a mobile platform. The antenna system comprises an antenna enclosure adapted to be mounted on the mobile platform. A phased array transmit antenna and a phased array receive antenna are mounted within the antenna enclosure adjacent to each other. The transmit antenna is packaged within the antenna enclosure in close proximity to the receive antenna. The antenna system further comprises spaced apart partition walls within the enclosure defining a space between the transmit antenna and the receive antenna. The partition walls are formed of a material providing an RF barrier. An electrical power supply is also mounted within the enclosure, and is located in the space between the partition walls. The antenna system also includes an antenna controller located in the space between the partition walls which is operative to control the transmit antenna and the receive antenna. The transmit and receive antennas respectively include a transmit aperture and a receive aperture. An adapter plate may be employed to mount the antenna enclosure on the mobile platform, and a fairing may be provided to cover the adapter plate. The fairing has an opening therein surrounding the transmit aperture and the receive aperture. The antenna enclosure also includes an integral transmit aperture plate, and an integral receive aperture plate. The antenna enclosure has an outer face that is provided with a set of grooves extending between the transmit aperture plate and the receive aperture plate. The grooves function as an RF choke to provide EMI reduction and RF isolation of the receive antenna from the transmit antenna. The grooves contain a dielectric material. Each of the transmit antenna and the receive antenna includes a layer of tiles arranged as an array, wherein each of the tiles includes an array of antenna elements, as well as a printed wiring board coupled with the tiles that include an antenna beam former. A plate is sandwiched between the layer of tiles and the printed wiring board for drawing heat away from the tiles and the printed wiring board, and for aligning the tiles with a corresponding one of the transmit aperture plate and a receive aperture plate. Each of the transmit aperture plate and the receive aperture plate includes an array of waveguide holes respectively aligned with the antenna elements.

According to another disclosed embodiment, a phased array antenna system is provided, comprising an antenna enclosure having an array of waveguides therein. The antenna system also includes an array of printed wiring assemblies arranged in a layer, each of the printed wiring assemblies containing a plurality of antenna elements respectively aligned with the waveguides, and a printed wiring board coupled with the array of printed wiring assemblies and including on array distribution assembly having an electric signal converter. The antenna system further comprises a plate sandwiched between the array of printed wiring assemblies and the printed wiring board, and a plurality of alignment pins passing through the plate, the printed wiring board and each of the printed wiring assemblies for aligning the antenna elements with the array of waveguides. The antenna enclosure includes an integral aperture plate. The array of waveguides are formed in the aperture plate. The antenna system also includes fasteners attached to the plate and passing through the printed wiring board and each of the printed wiring assemblies for attaching the plate, the printed wiring board and each of printed wiring assemblies to the aperture plate. The antenna system further comprises a power supply inside the antenna enclosure and coupled with the printed wiring board, and an antenna controller located inside the antenna enclosure and coupled with the printed wiring board.

According to still another disclosed embodiment, a low-profile, phased array antenna system is provided. The antenna system comprises an antenna enclosure containing a steerable beam transmit antenna and a steerable beam receive antenna. The transmit antenna includes a transmit aperture through which radio frequency signals may be transmitted, and a transmit sub-array tile assembly that includes a plurality of transmit tiles each having a plurality of transmit antenna elements for transmitting radio frequency signals. The transmit antenna also includes a transmit distribution assembly for delivering radio frequency signals to the transmit sub-array tile assembly. The receive antenna includes a receive aperture through which radio frequency signals may be received, and a receive sub-array tile assembly that includes a plurality of receive tiles each having a plurality of receive antenna elements for receiving radio frequency signals. The receive antenna also includes a receive array distribution assembly for converting the radio frequency signals received by the receive antenna elements to intermediate frequencies. The transmit tiles are arranged in an array, and the transmit distribution assembly is arranged as a layer beneath the transmit tiles. The receive tiles are also arranged in an array, and the receive distribution assembly is arranged as a layer beneath the receive tiles. The antenna system further comprises a first alignment and cold plate sandwiched between the transmit tiles and the transmit distribution assembly for drawing heat away from the transmit tiles and the transmit distribution assembly, and for aligning the transmit tiles with the transmit aperture The antenna system further includes a second alignment and cold plate sandwiched between the receive tiles and the receive distribution assembly for drawing heat away from the receive tiles and the receive distribution assembly, and for aligning the receive tiles with the receive aperture. The antenna system further includes a power supply coupled with the transmit distribution assembly and the receive distribution assembly, and an antenna controller for controlling the transmit antenna and the receive antenna. The power supply and the antenna controller are located between the transmit antenna and the receive antenna, and the antenna enclosure includes partition walls providing radio frequency isolation of the power supply and the antenna controller from the transmit antenna and from the receive antenna.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

Figure 1:
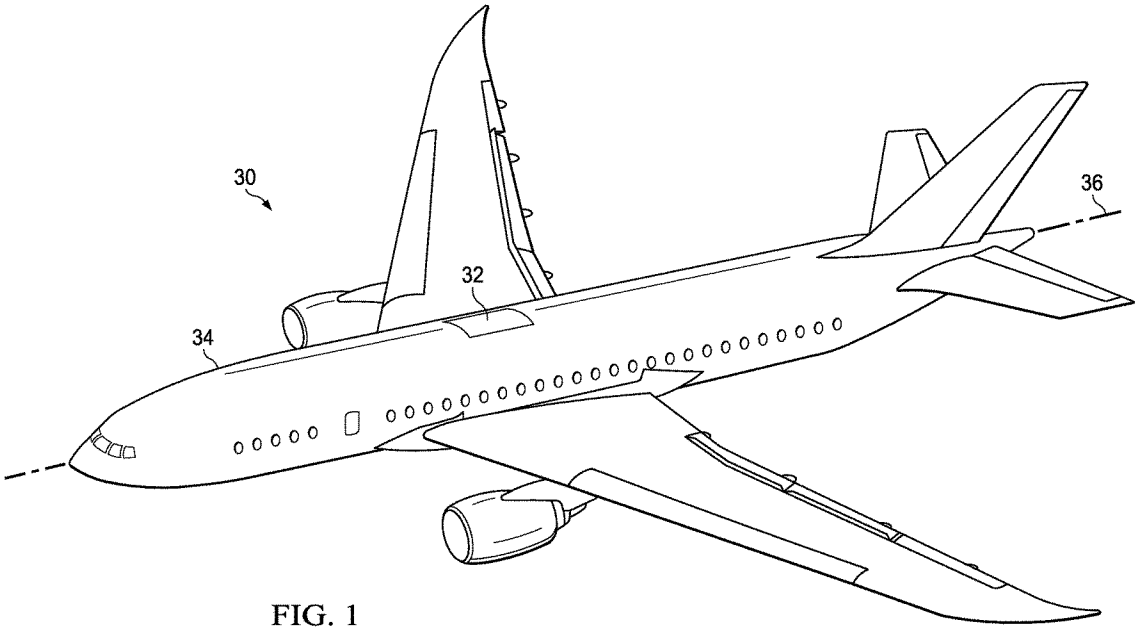
FIG. 1 is an illustration of a perspective view of an airplane having an integrated, low profile, phased array antenna system according to the disclosed embodiments.
Figure 2:
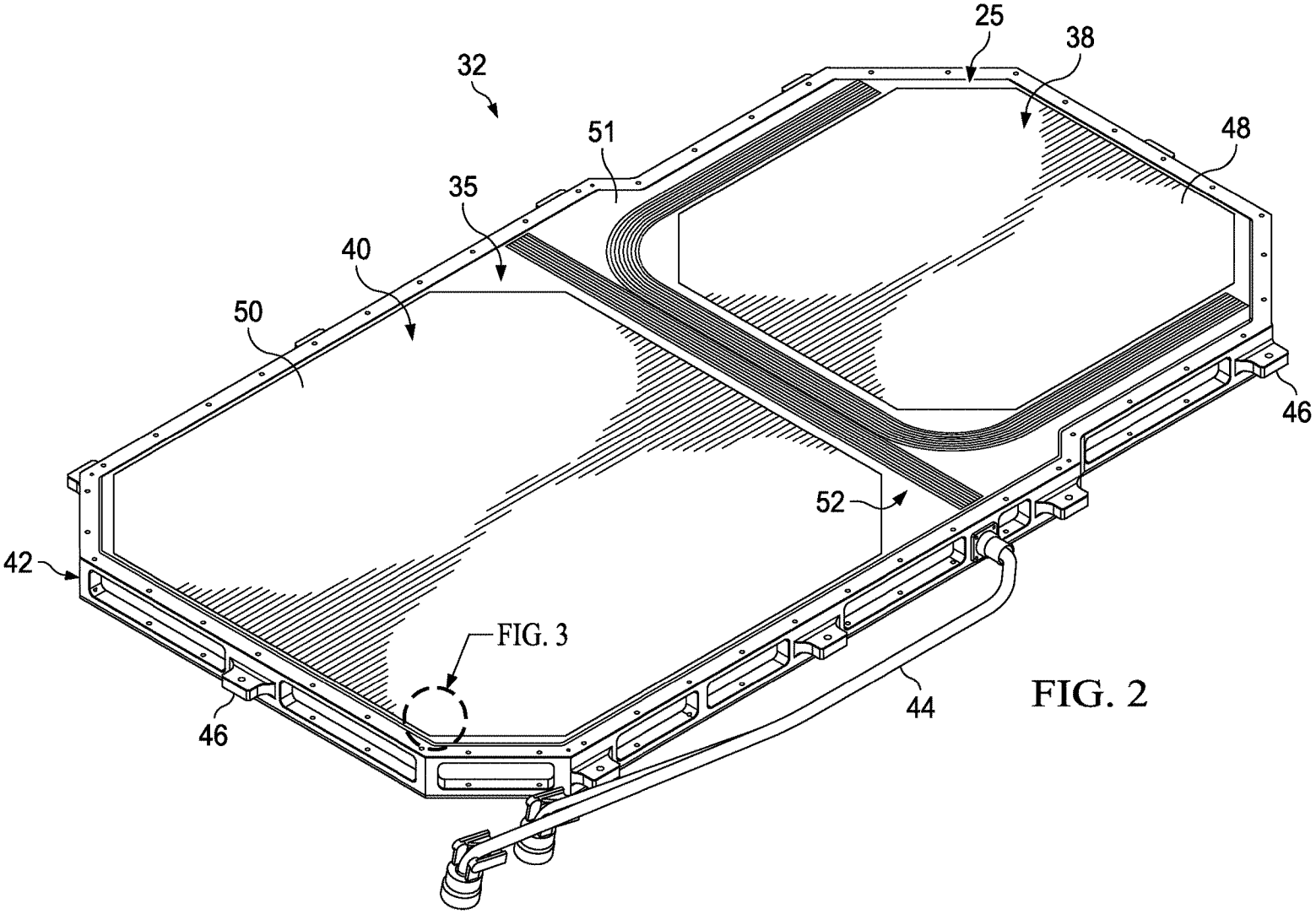
FIG. 2 is an illustration of a top perspective view of the antenna system shown in FIG. 1.

Referring first to FIGS. 1 and 2, a highly integrated, low profile phased array antenna 32 may be mounted on a mobile platform, such as an airplane 30 for transmitting and receiving RF (radio frequency) signals. For example, the antenna 32 may connect the airplane 30 with satellites forming part of a satellite communication (SATCOM) system (not shown). In the illustrated example, the antenna 32 is mounted on top of the airplane's fuselage 34, aligned with the airplane's longitudinal axis 36, however other mounting locations are possible, depending upon the application.

Referring particularly to FIG. 2, the antenna integrates an electronically steerable, phased array transmit antenna 25 and an electronically steerable, phased array receive antenna 35 packaged in close proximity to each other within a common antenna enclosure 42, hereafter sometimes referred to as a chassis 42. The chassis 42 may be formed of a cast or machined material such as aluminum or similar RF shielding material, including but not limited to metallized plastic or composites, and may be provided with mounting lugs 46. The transmit antenna 25 includes a transmit aperture 38 located at the aft end of the antenna 32 for transmitting electronically steered RF signal beams. Similarly, the receive antenna 35 includes a receive aperture 40 at the forward end of the antenna 32 for receiving one or more RF signal beams. In the illustrated embodiment, the transmit and receive antennas 25, 35 each have a rectilinear geometries, however other geometries are possible. The size of the transmit and receive antennas 25, 35 may vary with the application, and as will be discussed below, the architecture of these antennas allows them to be readily scalable to any desired size.

RF isolation of the receive aperture 40 from the transmit aperture 38 is achieved by an RF choke comprising a series of grooves 52 in the top face 51 of the chassis 42 which extend both transversely across the chassis 42 between the transmit and receive apertures 38, 40, and around three sides of the transmit aperture 38. The grooves 52 may be filled with a suitable dielectric material. The transmit antenna 25 includes a laminated wide angle impedance match cover 48, hereinafter referred to as a WAIM cover 48, over the transmit aperture 38, while the receive antenna 35 includes a laminated WAIM cover 50 over the receive aperture 40. Each of the WAIM covers 48, 50 is a multilayer dielectric laminate, covered by an outer facesheet or appliqué that protects the cover from the environment. The WAIM covers 48, 50 minimize the range of impedance presented to the antenna element amplifier over the design scan range, thereby improving amplifier efficiency across the scan. A single set of cables 44 couple the antenna 32 with the airplane's onboard power, control and communication systems.

Figure 3:
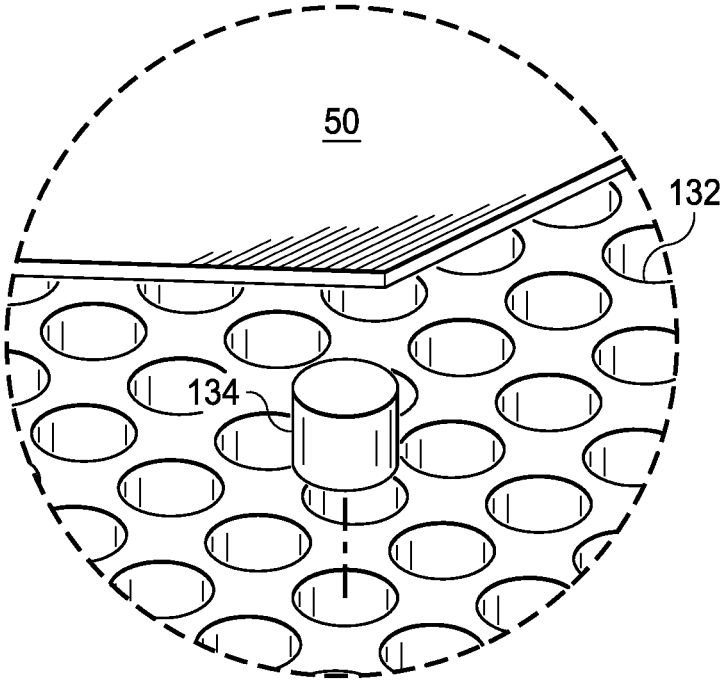
FIG. 3 is an illustration of the area designated as "FIG. 3" in FIG. 2, wherein a WAIM cover is slightly raised to reveal waveguide apertures and a dielectric plug.
Figure 4:
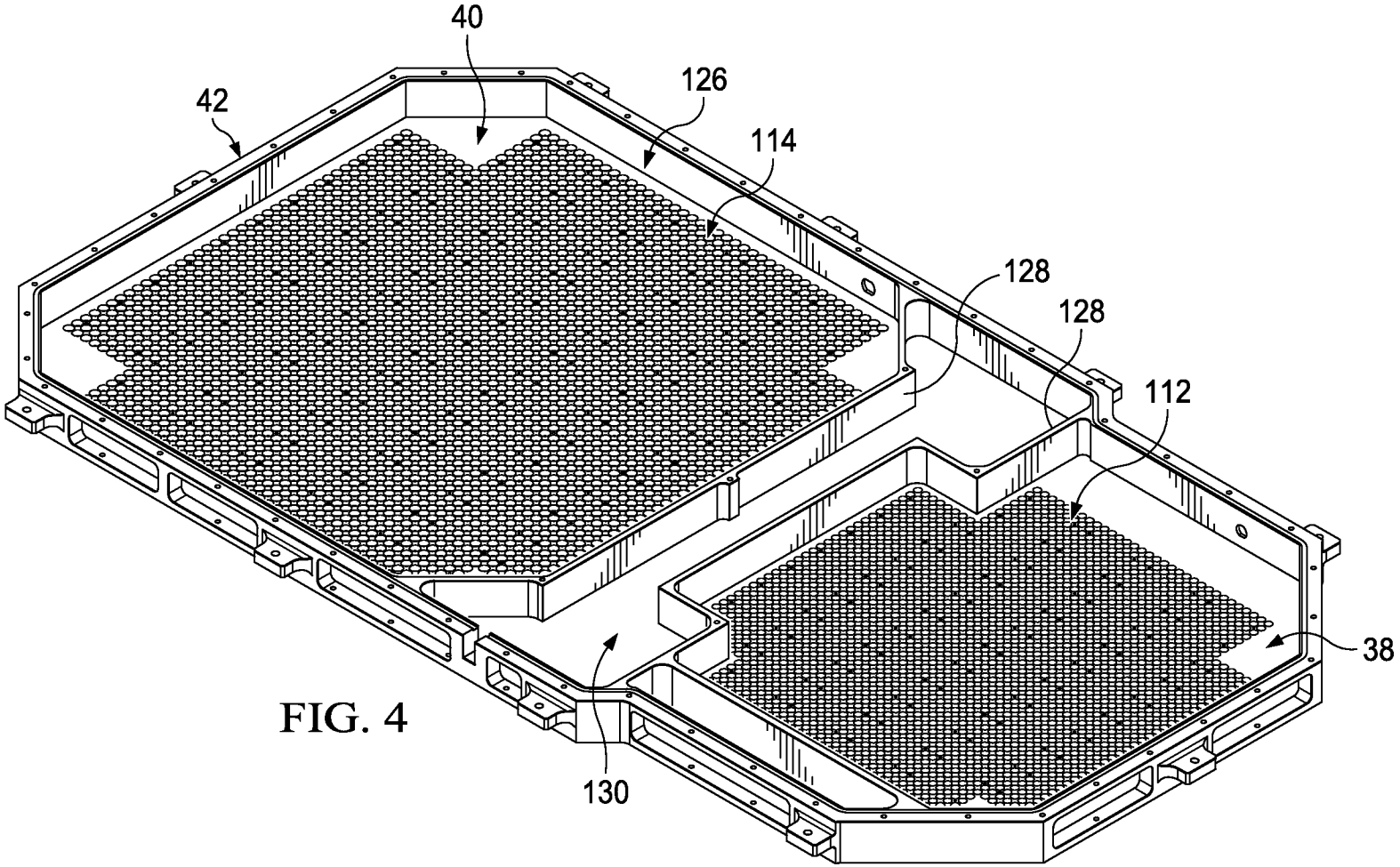
FIG. 4 is an illustration of a bottom perspective view of the chassis, a bottom cover plate and internal components removed to more clearly show the transmit and receive aperture plates.

Referring now to FIGS. 3 and 4, the chassis forms an open, internal enclosure 126 for housing a series of later discussed stacked physical layers forming the transmit and receive antennas 25, 35 respectively. The top side of the chassis 42 includes integrally formed transmit and receive aperture plates 112, 114, each having an array of waveguide holes 132, that are circular in cross section, and pass through the aperture plates 112, 114. The diameter and spacing of the waveguide holes 132 are design parameters of the antenna that vary with the intended operating frequency. Typically, for example, the spacing of the waveguide holes 132 is proximally ½ wavelength of the maximum operating frequency. As the frequency increases, the spacing between the waveguide holes 132 decreases. The diameter of the waveguide holes 132 may be varied by tailoring the dielectric constants of the waveguide plugs 134. In the illustrated embodiment, the integral transmit aperture plate 112 contains a 2048 array of waveguide holes 132, that are circular in cross section, while the integral receive aperture plate 114 contains a 2880 array of waveguides 132. Each of the circular waveguide holes 132 contains a dielectric plug 134 (only one dielectric plug is shown in FIG. 3). The interior of the chassis 42 includes a pair of spaced apart, integrally formed partition walls 128 defining a space 130 between the transmit and receive apertures 38, 40 which extends substantially the entire width of the chassis 42. A bottom cover plate 124 (see FIG. 8) is attached to and covers the bottom of the chassis 42. A gasket (not shown) may be employed to form an airtight seal between the cover plate 124 and the bottom of the chassis 42.

Figure 5:
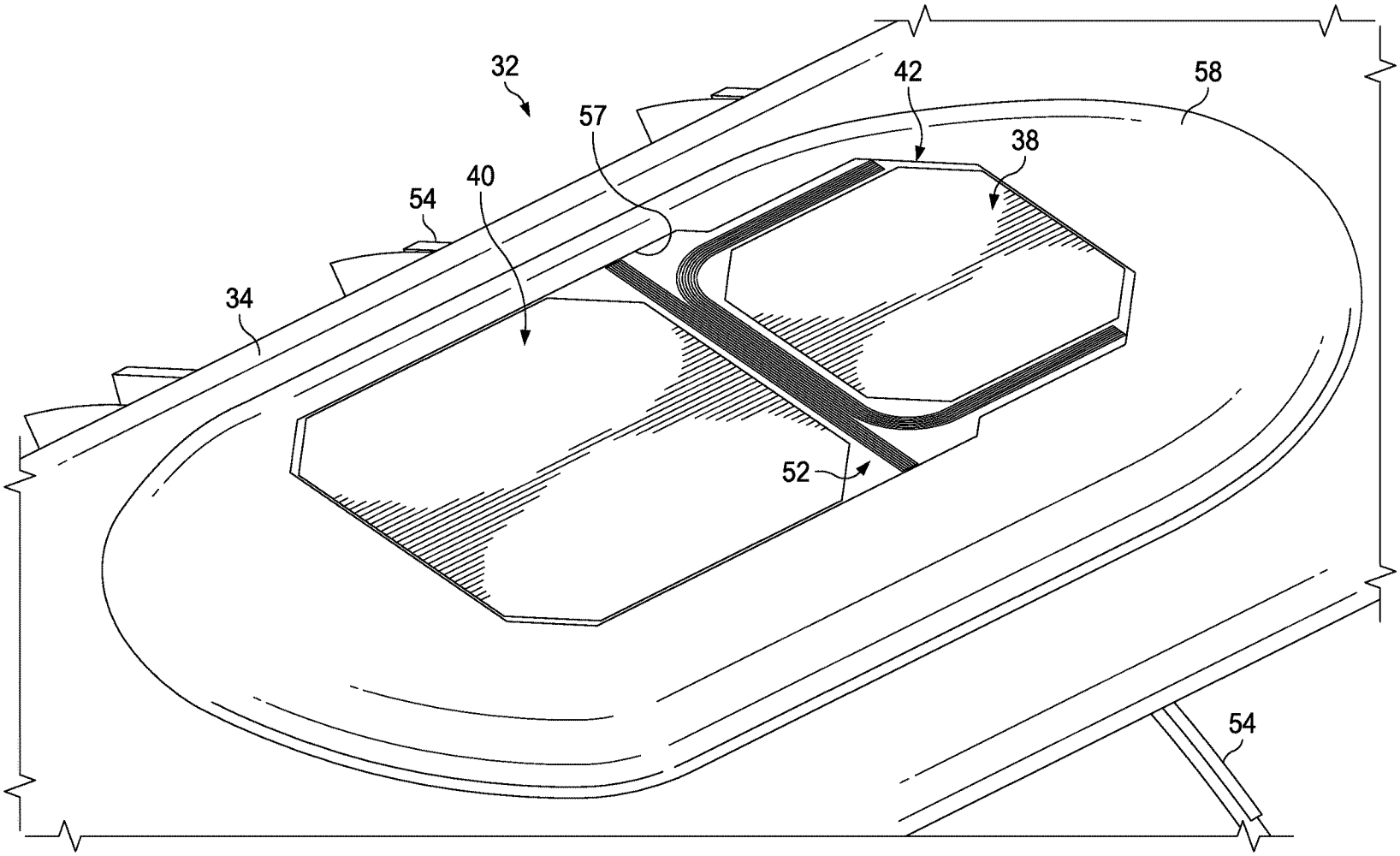
FIG. 5 is an illustration of a top perspective view of the antenna system shown in FIG. 1, including an aerodynamic fairing, parts of the airplane's fuselage skin broken away to reveal underlying airframe members.
Figure 6:
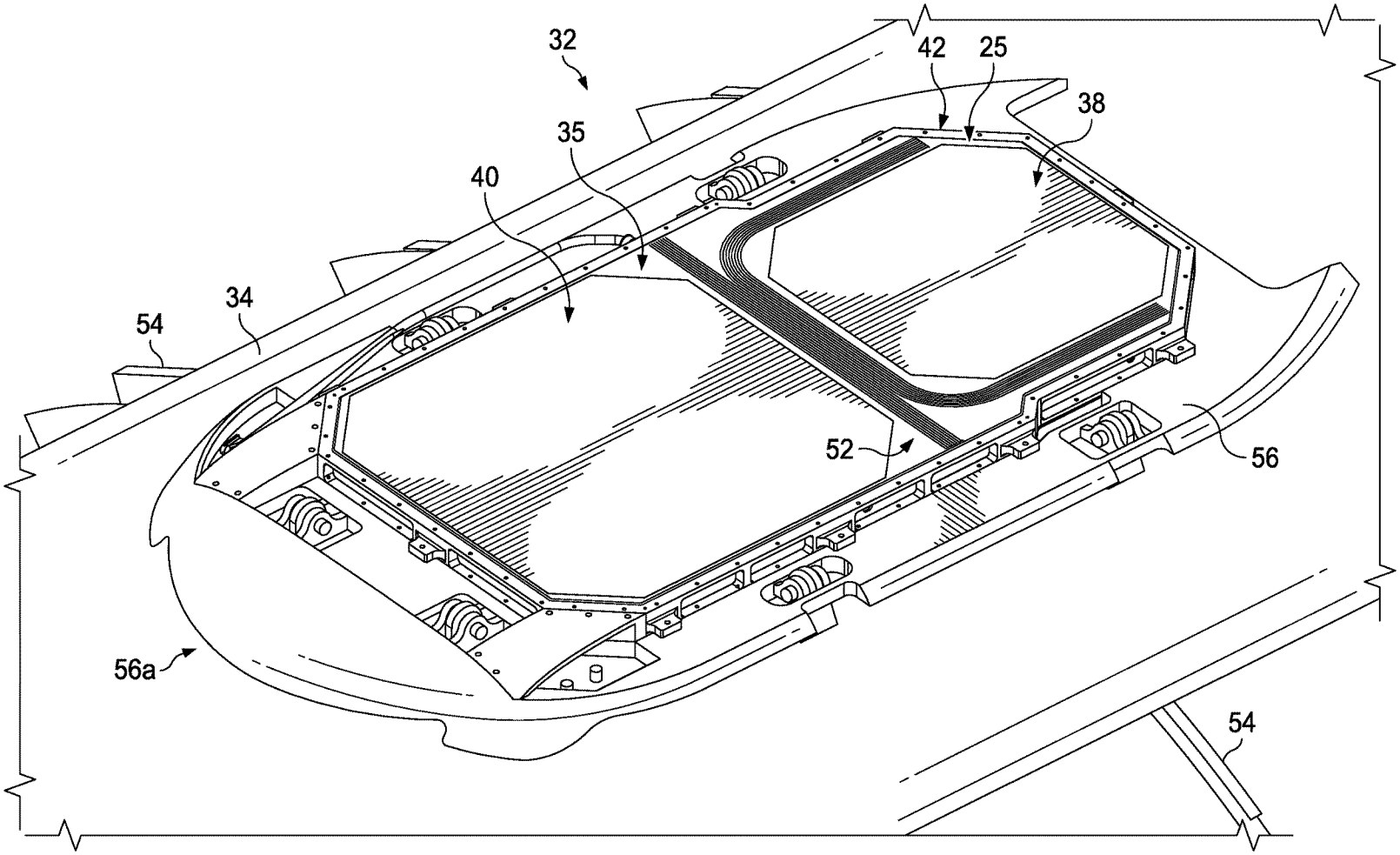
FIG. 6 is an illustration similar to FIG. 5, but wherein an aerodynamic fairing is removed to reveal details of an adapter plate.

Referring to FIGS. 5 and 6, an adapter plate 56, suitable for the particular application, adapts the antenna 32 for mounting on the airplane fuselage 34. The antenna 32 is mounted on the adapter plate 56 using the lugs 46 on the chassis 42 and suitable fasteners (not shown). The adapter plate 56 has a forward end **56*a* that is configured to deflect and/or absorb impacts, such as bird strikes. The adapter plate 56 may be formed of any suitable, rigid material and is secured to underlying airframe members 54 using suitable fasteners (not shown). The adapter plate 56 is aligned to the airplanes navigational sensor (not shown), and has features that permit the antenna to be removed and replaced on the adapter plate 56 without the need for realignment of the antenna 32 with the airplane 30, thereby facilitating rapid repair. An aerodynamic faring 58 covers the adapter plate 56 and has an opening 57 that exposes the closely spaced apart transmit and receive apertures 38, 40** to the sky.

Figure 7:
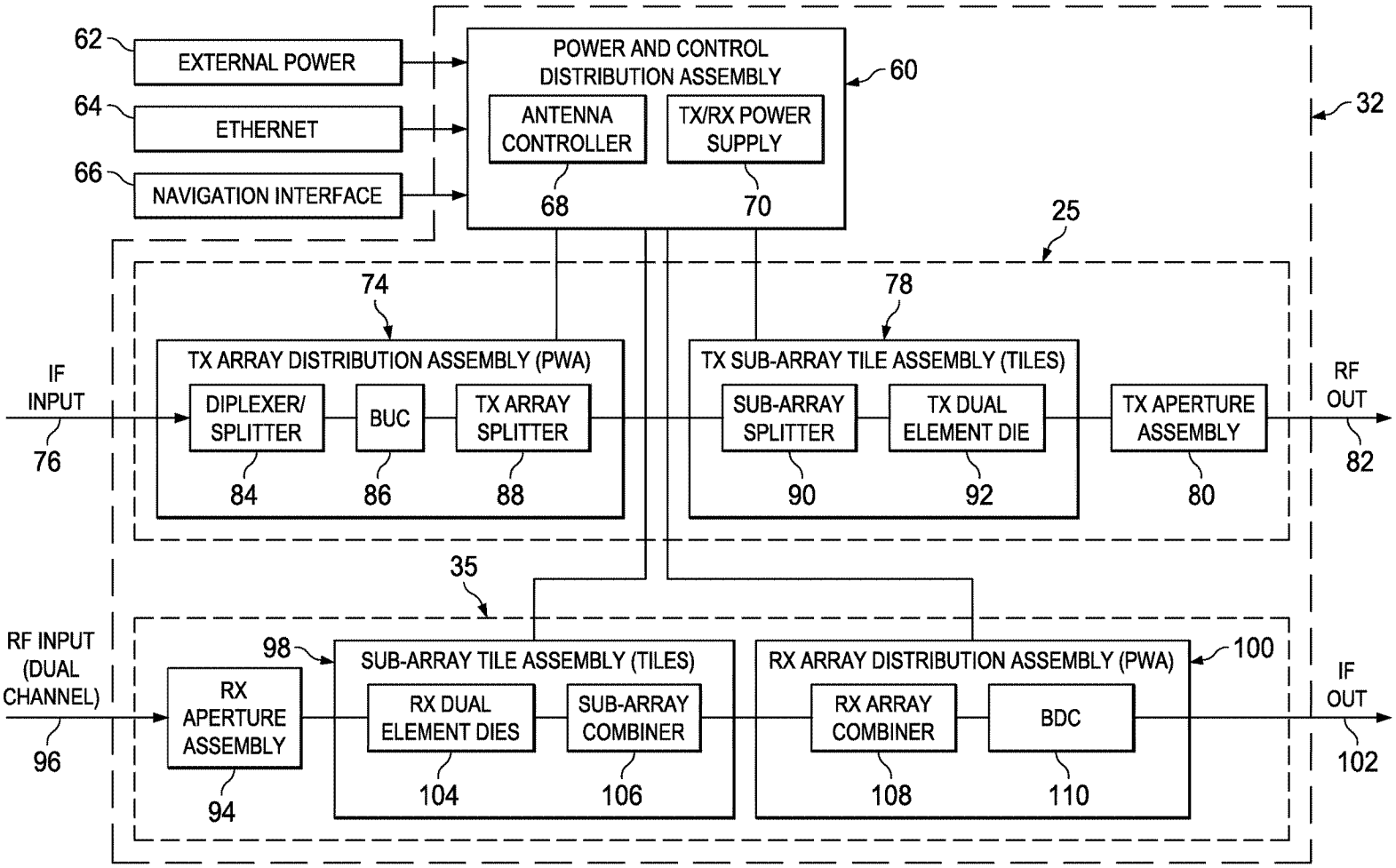
FIG. 7 is an illustration of a block diagram showing functional components and electrical sub-systems of the antenna system.

Attention is now directed to FIG. 7 which illustrates, in block diagram form, functional components and electrical subsystems of the phased array antenna 32, all of which are packaged in the low profile chassis 42 described above. Power and control signals are routed through a power and control distribution assembly 60 which is connected by the cables 44 (FIG. 2) to external power 62, an Ethernet network 64 and a navigation interface 66 onboard the airplane 30. The power and control distribution assembly 60 includes an electrical power supply 70 that provides power to both the transmit and receive portions of the antenna discussed below, as well as an antenna controller 68 that controls operation of the transmit and receive antennas 25, 35, respectively. Additionally, the antenna controller 68 receives navigation data from onboard the airplane, and uses this data to compute the specific phase setting for of the each antenna elements in each aperture, resulting in the formation of a directed beam or beams in the desired direction.

The transmit antenna 25 broadly comprises a transmit array distribution assembly 74, a transmit sub-array tile assembly 78 and an transmit aperture assembly 80. The transmit array distribution assembly 74 includes a diplexer/splitter 84, a block up converter (BUC) 86, and a transmit array splitter 88. IF (intermediate frequency) input signals 76 are up-converted as a block to RF and amplified by the BUC 86, and then split into a plurality of signals by the array splitter 88 before being delivered to the sub-array tile assembly 78. The splitter 90 splits incoming RF signals and delivers them to dual element dies 92 on each of the transmit tiles 160 (FIGS. 13-16) that form the sub-array tile assembly 78. In some embodiments, however, the dies 92 may be single element dies or multi-element dies, as desired. The ability to select the number of elements per die facilitates scalability, allowing progressive levels of higher integration, if desired. As will be discussed later in more detail, the transmit sub-array tile assembly 78 comprises an array transmit tiles 160 (see FIGS. 13-16), each of which comprises a printed wiring assembly having antenna elements (not shown) that are respectively aligned with the circular waveguide holes 132 (FIG. 3) in the transmit aperture plate 112 (FIG. 4).

In the illustrated embodiment, the transmit aperture 38 is formed by 32 of the transmit tiles 160, however fewer or greater numbers of the transmit tiles 160 may be employed, depending upon the application, and the desired size of the transmit aperture 38. The antenna elements (not shown) transmit RF signals that pass through the transmit aperture assembly 80 and are transmitted as an RF output signal 82 forming part of an electronically steered transmit beam. The operating frequencies of the transmit antenna 25 may vary with the application. For example, in one embodiment, incoming IF signals 76 in the range of 950-1450 MHz are converted and transmitted as RF signals 82 in the Ku band between 14.00 and 14.50 GHz.

The receive antenna 35 includes a receive aperture assembly 94 for receiving RF input signals 96. In the illustrated embodiment, the receive aperture assembly 94 is configured to receive dual "channel" input signals 96, however in other embodiments the receive aperture assembly 94 can be configured to receive a single channel or more than two channels of RF input signals 96. Each input channel has a unique and independent electronics chain (signal path) that allows for an independently steerable beam for each channel. The received RF input signals 96 are picked up by antenna elements forming part of dual element dies 104 on receive tiles 156 in the sub-array receive tile assembly 98. Each of the receive tiles 156 includes a sub-array combiner 106 which combines the received RF signals and outputs them to a receive array distribution assembly 100. A receive array combiner 108 combines the RF signals and delivers them to a block down converter (BDC) 110 which down converts the RF signals to IF output signals 102. As will be discussed below in more detail, the various functional assemblies and subsystems shown in FIG. 7 are highly integrated and are contained in only a few physical layers that allow them to the closely stacked within the low profile chassis 42. The operating frequencies of the receive antenna 35 may vary with the application. For example, in one embodiment, received RF signals 96 in the Ku band between 10.70 and 12.75 GHz are converted to IF signals in the frequency range of 950-2150 MHz.

Figure 8:
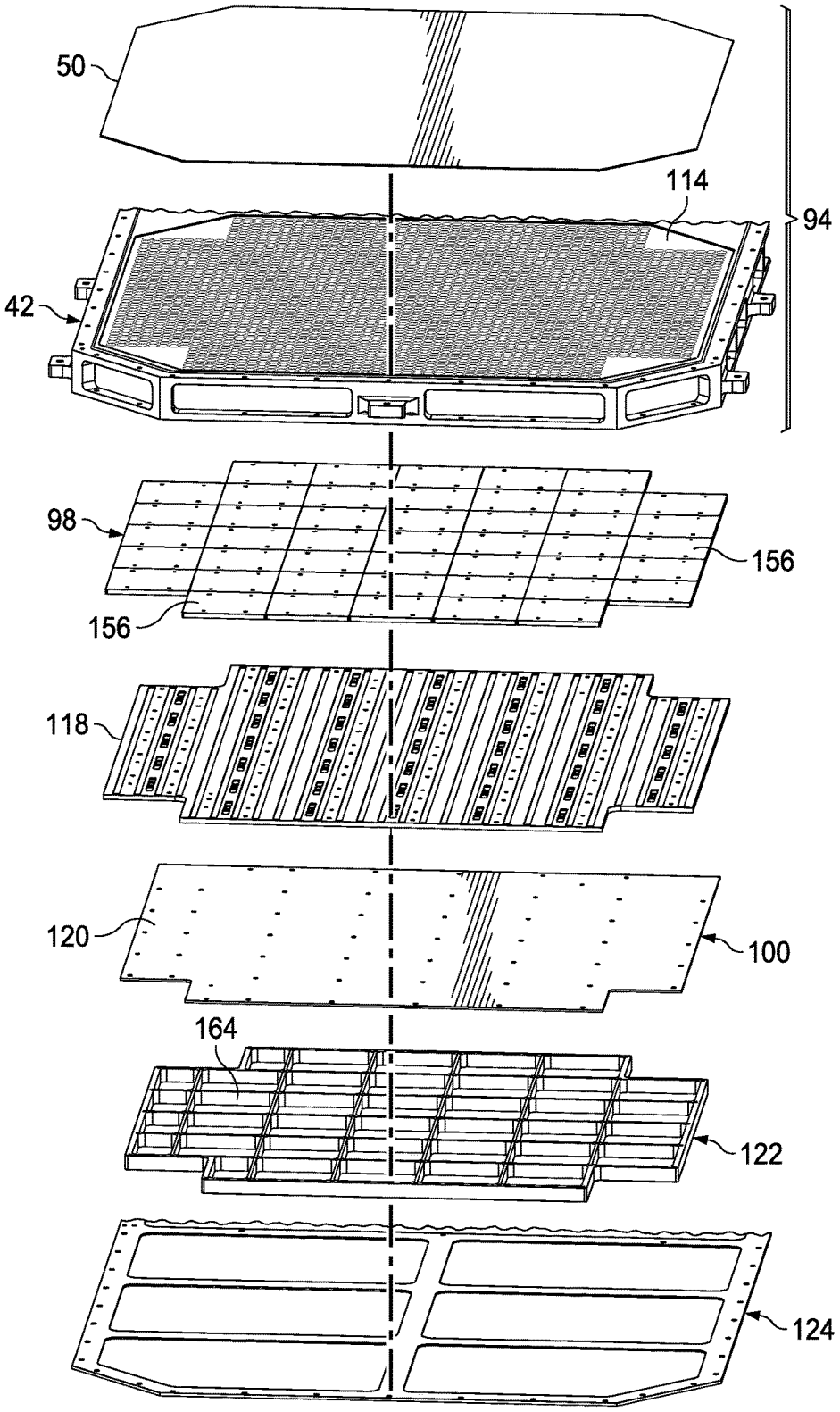
FIG. 8 is an illustration of an exploded perspective view showing the stacked physical layers of the receive antenna.

FIG. 8 illustrates the stacked physical layers forming the receive antenna 35. The WAIM cover 50 overlies the receive aperture plate 114 that is integrated into the chassis 42. The receive sub-array tile assembly 98 form a layer of tiles that is immediately beneath the receive aperture plate 114. As will be discussed later in more detail, the receive sub-array tile assembly 98 comprises an array of the receive tiles 156, each of which comprises, as mentioned previously, a printed wiring assembly having antenna elements that are respectively aligned with the circular waveguide holes 132 (FIG. 3) in the receive aperture plate 114. The each of the receive tiles in the receive sub-array tile assembly 98 combines both the dual element tiles 104 and the sub-array combiner 106 which functions to combine the RF signals from the dual element dies 104 into a single block of signals that are delivered to the receive array distribution assembly 100. An alignment and cold plate 118 is sandwiched between the sub-array tile assembly 98 and the receive array distribution assembly 100 on a printed wiring board 120.

The receive array distribution assembly 100 contains a later discussed distribution network or array combiner 108 (FIG. 7), sometimes referred to as a combiner network or beam former, and the down converter 110. Each of the receive tiles 156 in the receive sub-array tile assembly 98 is electrically connected with the circuitry on the printed wiring board 120 by later discussed interconnect elements 162 (FIG. 18) that pass though the alignment and cold plate 118. The assembly 98 of tiles 156, the alignment and cold plate 118 and the printed wiring board 120 are held in aligned relationship with each other and with the receive aperture plate 114 by later discussed alignment pins and fasteners. A structural stiffening plate 122 is located beneath the printed wiring board 120 and functions to stiffen the sandwiched assembly, while also providing RF isolation of certain circuits on the printed wiring board 120, such as the up or down converter circuits. The stiffening plate 122 includes later discussed pockets 164 that prevent RF leakage or cross talk between the adjacent RF circuits on the board 120.

Figure 9:
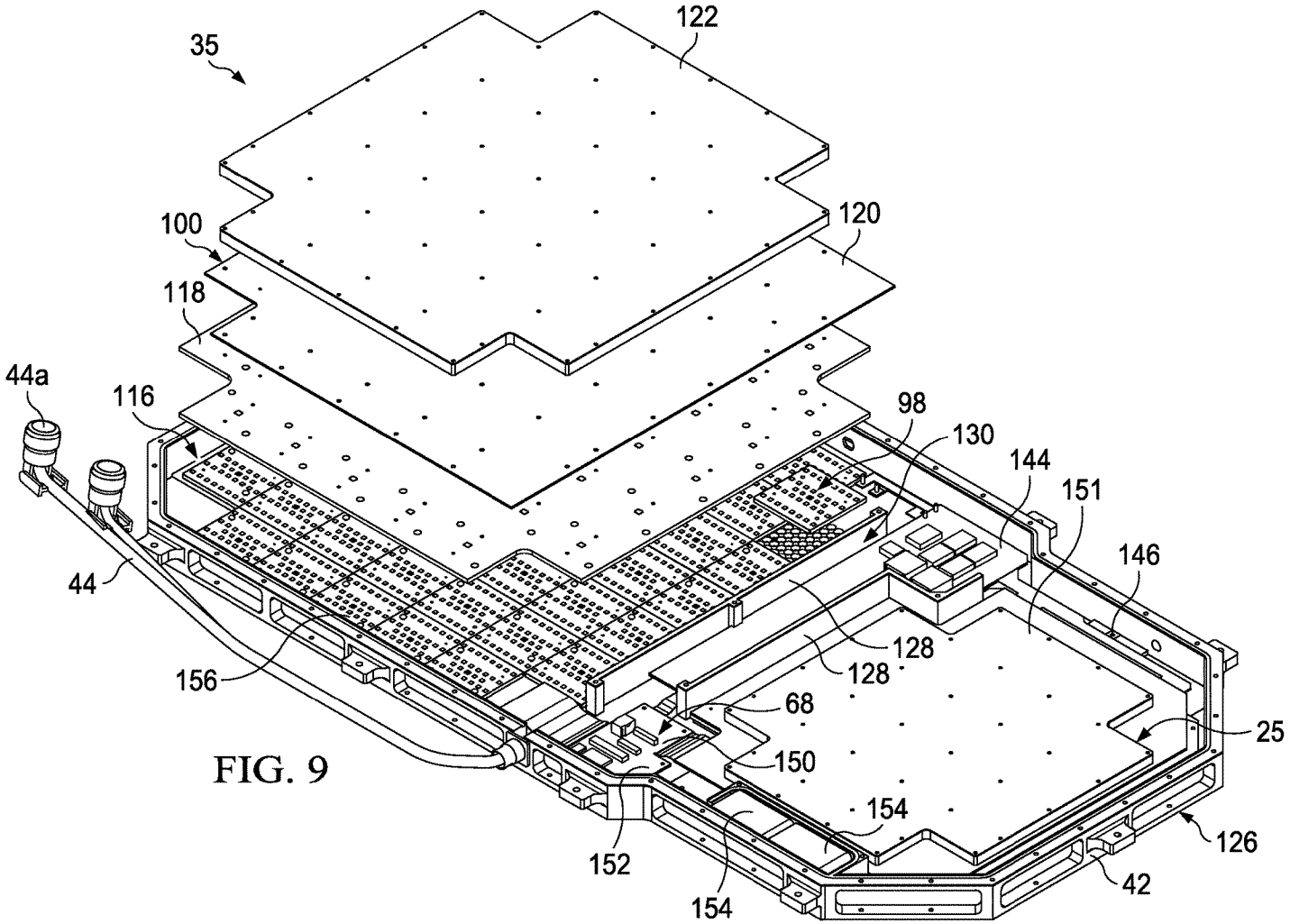
FIG. 9 is an illustration of a bottom perspective view of the chassis, layers of the receive antenna exploded to reveal a receive tile array.
Figure 13:
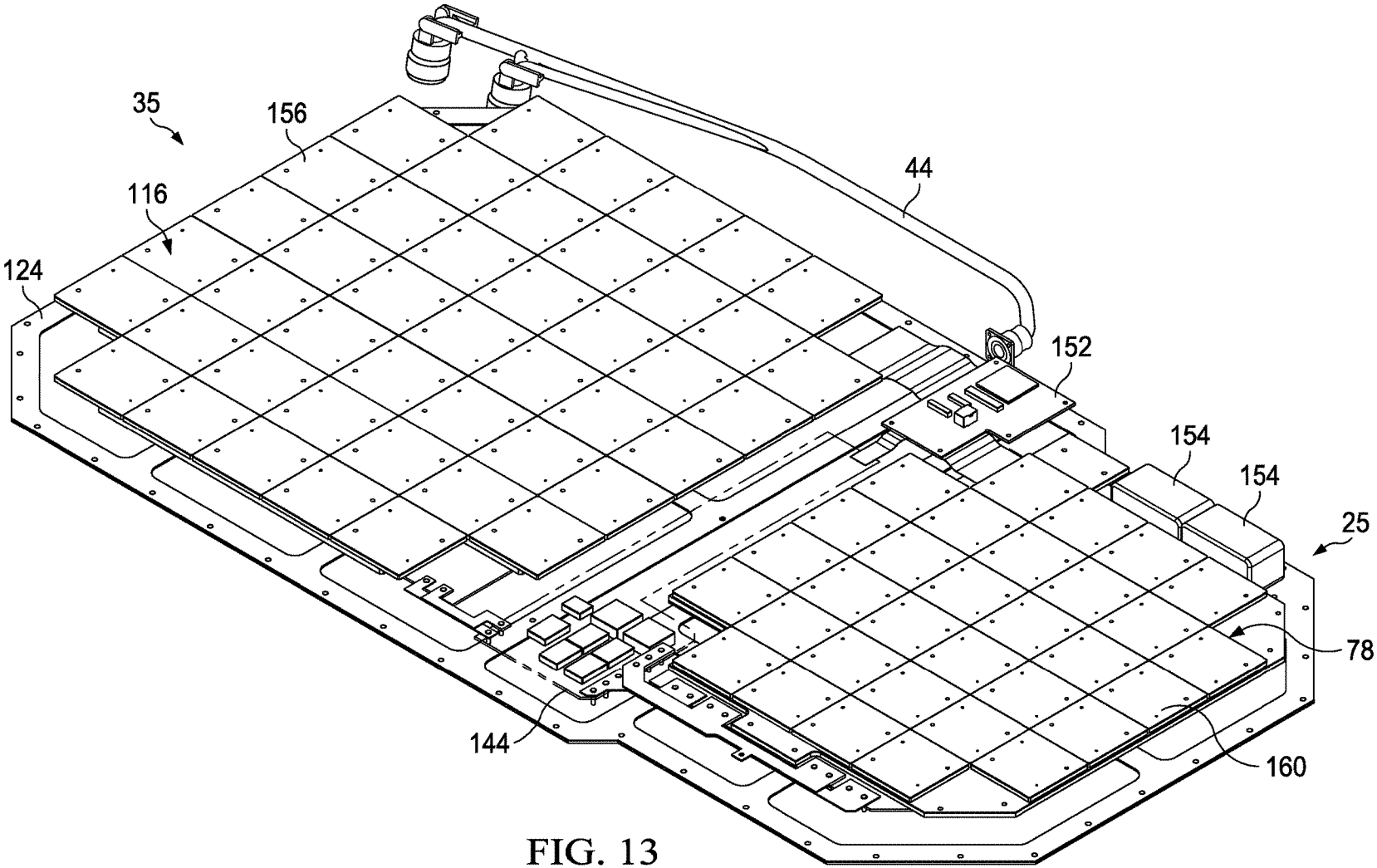
FIG. 13 is an illustration of a top perspective view similar to FIG. 12, but with the WAIM covers removed to reveal the transmit and receive tile arrays.
Figure 14:
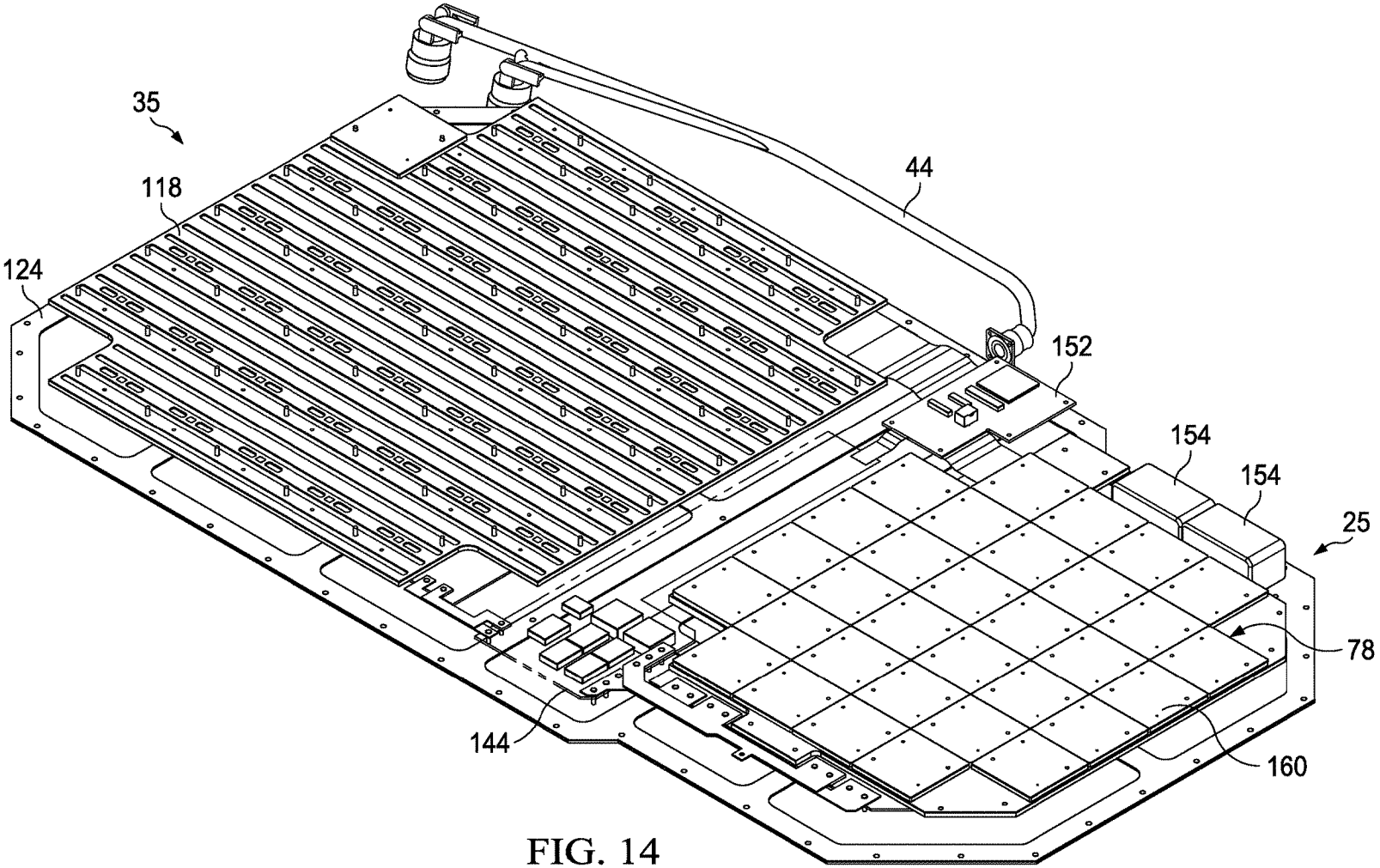
FIG. 14 is an illustration similar to FIG. 13, but wherein the receive tile array has been removed to reveal an underlying alignment and cold plate.

Referring to FIGS. 7 and 9, the overall architecture and physical layers of the transmit antenna are similar to those of the receive antenna 35 discussed above. The transmit array distribution assembly comprising a printed wiring assembly on a printed wiring board 146 underlies a sub-array tile assembly 78 (FIG. 13). The sub-array tile assembly 78 is formed by an array of transmit tiles 160, each comprising a printed wiring assembly containing a sub-array of dual circuit dies or elements that include an array of antenna elements. An alignment and cold plate (not shown) is sandwiched between the sub-array tile assembly 78 and the transmit array distribution assembly 74, and an RF isolation plate 151 underlies the transmit array distribution assembly 74.

Attention is now directed to FIGS. 9-16 which illustrate additional details of the antenna 32. As previously mentioned, in the disclosed embodiment, the overall architectures of the transmit and receive antennas 25, 35 are essentially identical. However, in other embodiments it may be possible to use differing architectures for the transmit and receive antennas 25, 35. In still other embodiments, it may be possible to employ architectures other than tile-based architectures. In the following description, the physical layers and functional subsystems of the receive antenna 35 will be described, with the understanding that the transmit antenna 25 has a similar or essentially identical architecture and physical construction.

Referring particularly to FIG. 9, as previously mentioned, the receive tiles 156 in the transmit array distribution assembly 74 are arranged in an array 116 which, in the illustrated embodiment comprises an array of 45 RF receive tiles 156, each in the form of a printed wiring assembly including a sub-array of dies having antenna elements. Each of the receive tiles 156 further includes a circuit that implements the sub-array combiner 106 (FIG. 7) which integrates the RF signals from the dies 104 on that tile 156 and delivers these signals as a block to the underlying printed wiring board 120.

The receive distribution array distribution assembly 100 integrates the receive array combiner 108 and block down converter 110 on the same printed wiring board 120. Thus, the combiner network or beam former of the receive antenna 35 is integrated with the RF converter function on a common printed wiring board. The alignment and cold plate 118 may be formed of any thermally conductive material, such as, without limitation, aluminum and functions as a heat sink to draw heat away from the tiles 156 as well as away from the printed wiring board 120. In some embodiments, a heat transfer fluid may be circulated through the alignment and cold plate 118 to aid in drawing heat away from the tiles 156 and the printed wiring board 120. The alignment and cold plate 118 also functions as a mechanical reference point for aligning the various layers relative to each other and to the corresponding aperture plate.

Figure 10:
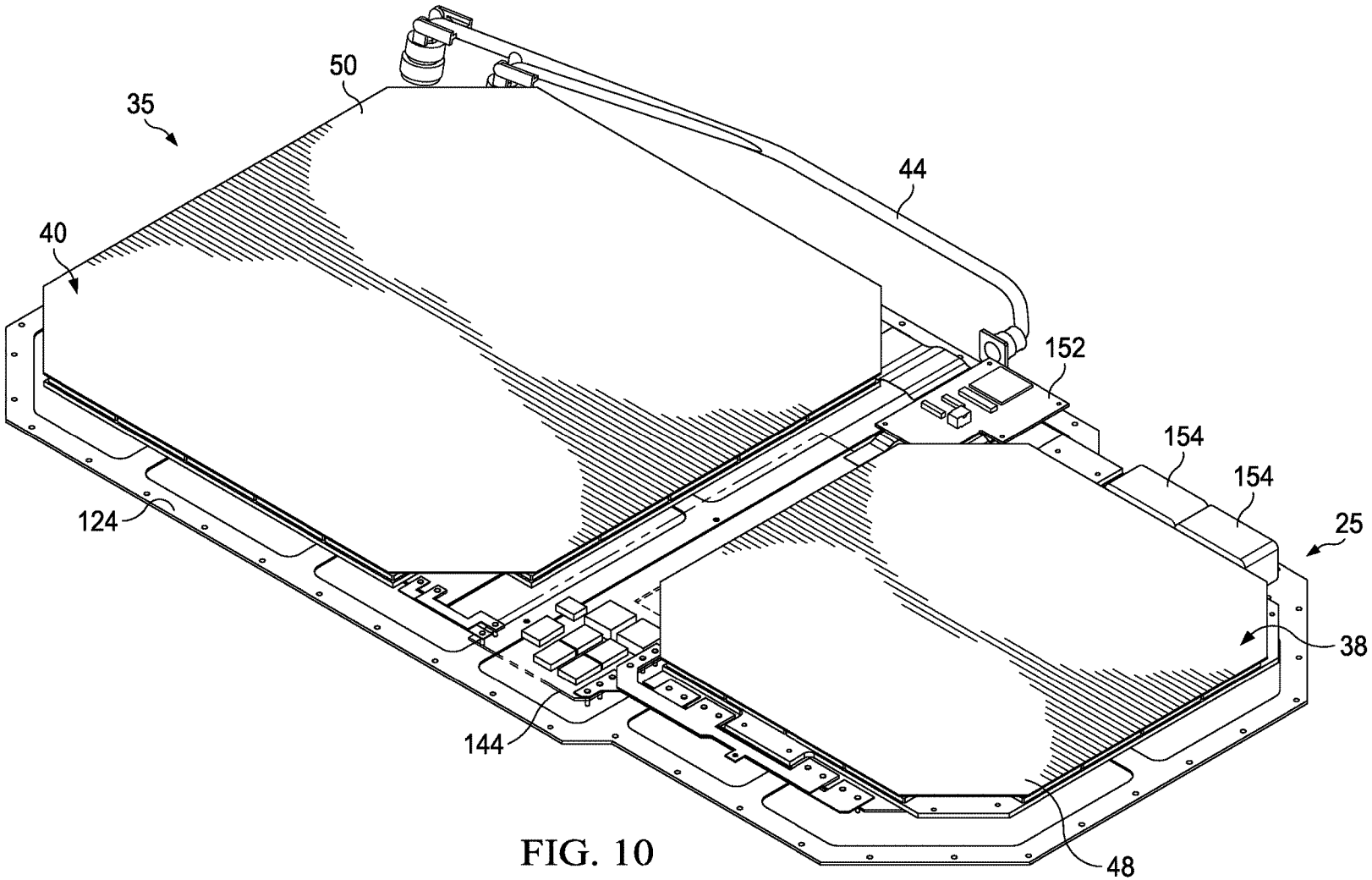
FIG. 10 is an illustration of a top perspective view of the antenna system, wherein the chassis is hidden to better show stacked physical layers of the antenna system.
Figure 11:
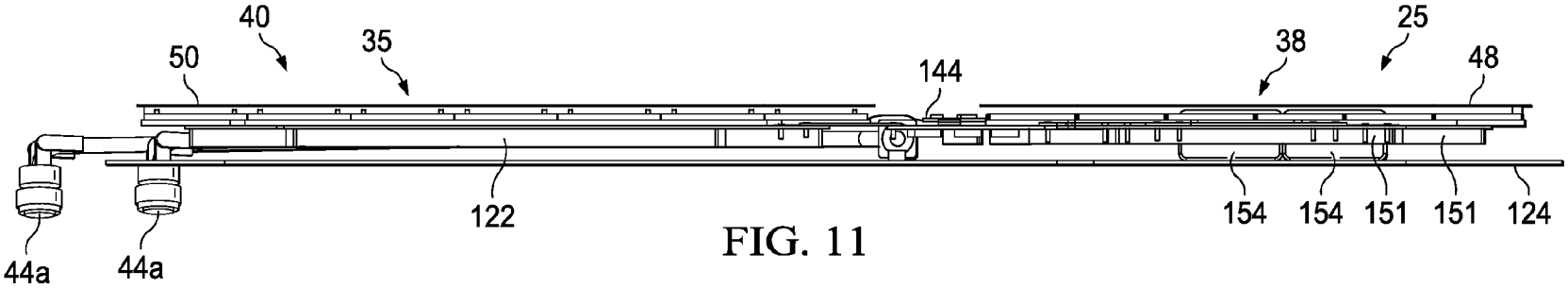
FIG. 11 is an illustration of a side view of the antenna system shown in FIG. 10.
Figure 12:
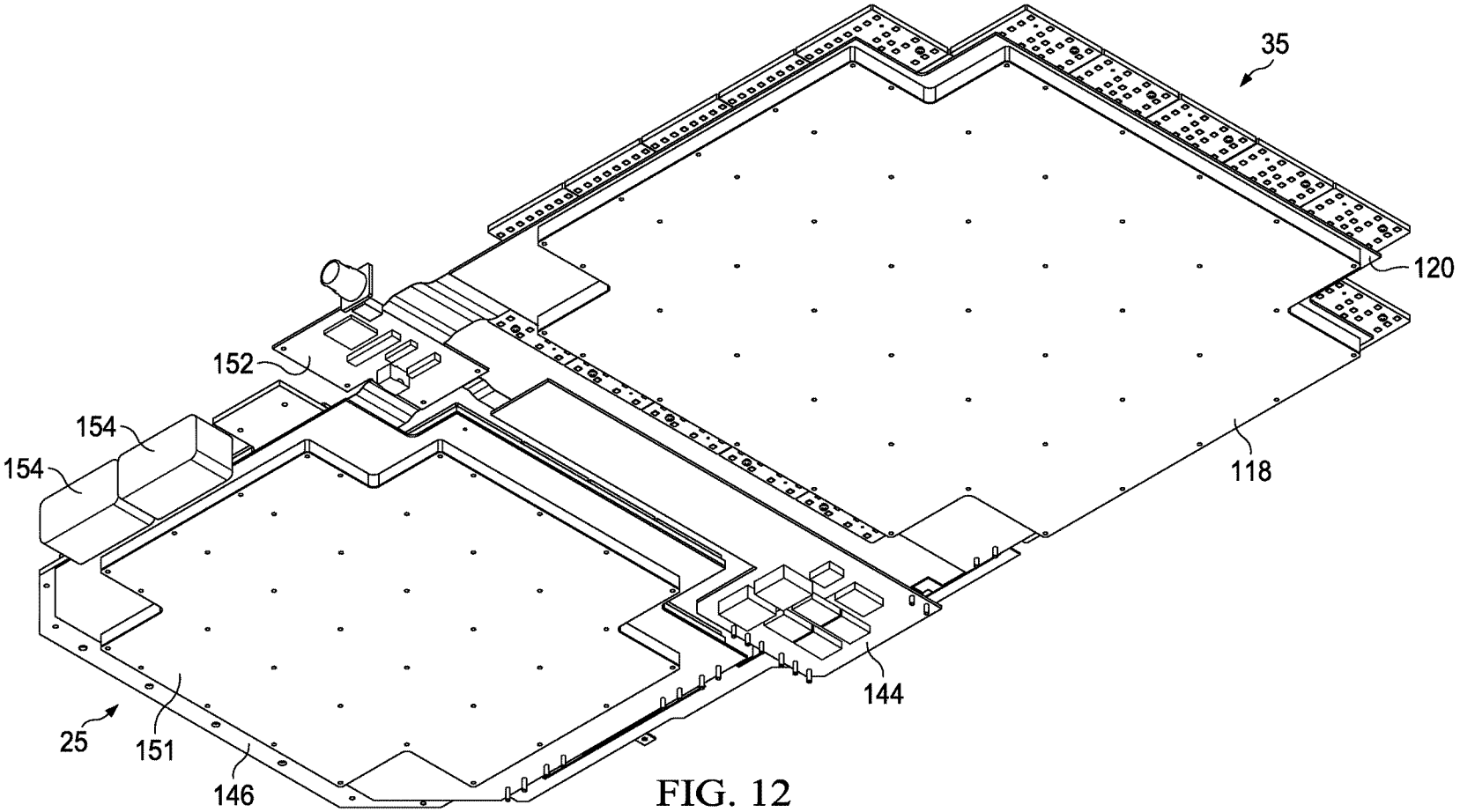
FIG. 12 is an illustration of a bottom perspective view of the antenna system, the chassis not shown for clarity.

The previously mentioned antenna controller 68 (FIG. 7) comprises a printed wiring assembly 152 located within the space 130 between the partition walls 128, along one side of the chassis 42. The transmit and receive power supply 70 (FIG. 7) is also located within the space 130 between the partition walls 128, on the other side of the chassis 42. The partition walls 128 form an RF barrier between the transmit and receive antennas 25, 35. As previously described, the receive array distribution assembly 138 comprises a printed wiring assembly that integrates a beam former and RF down converter. Similarly, the transmit antenna 25 integrates a transmit distribution assembly 74, including the up converter 86, in a printed wiring assembly contained on a single printed wiring board 146. Although not shown in FIG. 9, the transmit antenna 25 includes an array of transmit tiles 160 (FIG. 13) similar in construction to the receive tiles 156. Referring to FIGS. 10 and 11, the internal volume of the chassis 42 (FIG. 9) is vented through a pair of containers 154 holding a suitable desiccant for moisture control.

Figure 15:
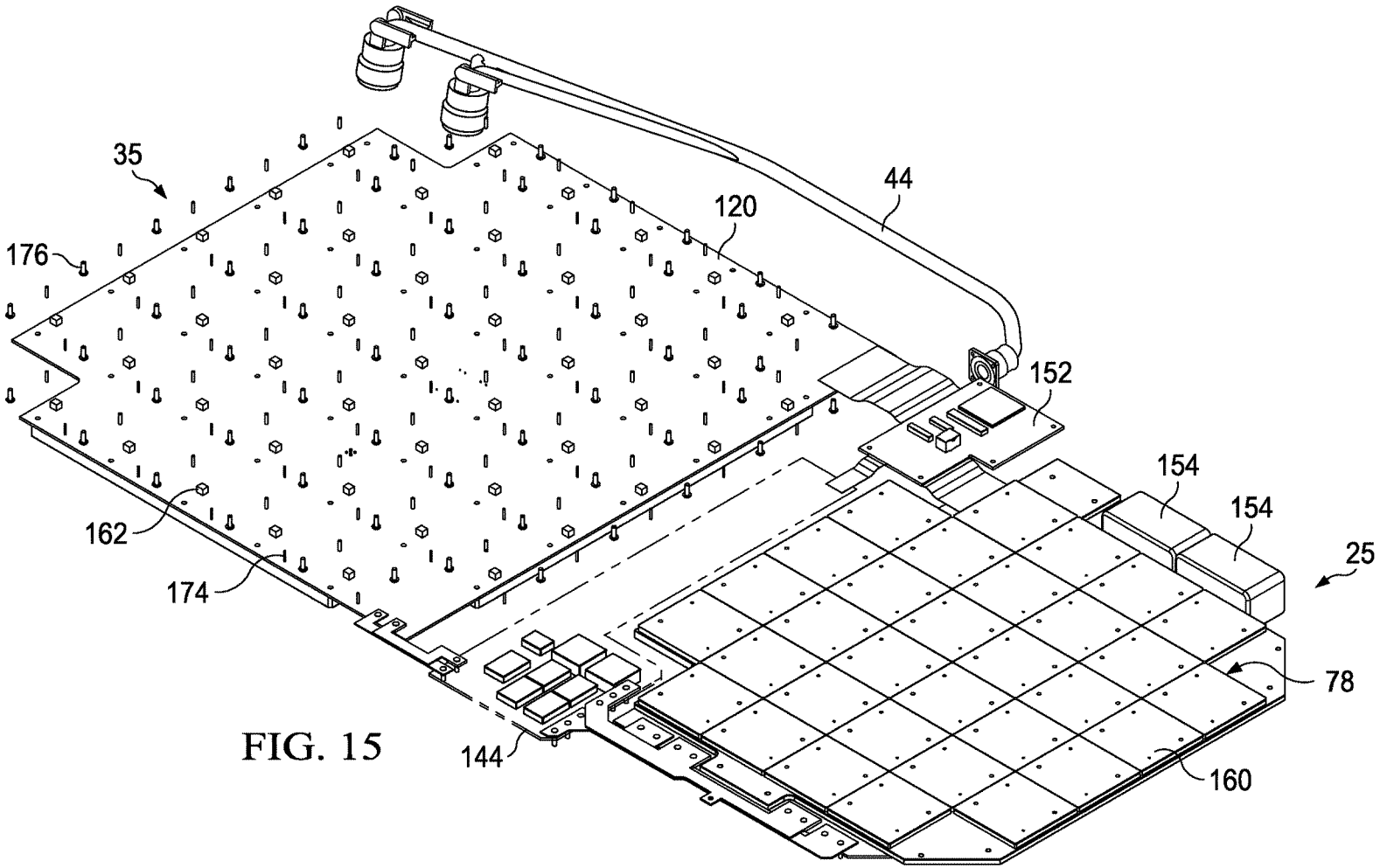
FIG. 15 is an illustration similar to FIG. 14, but wherein the alignment and cold plate and bottom chassis cover plate have been removed to better show an underlying printed wiring board forming part of the receive antenna.
Figure 16:
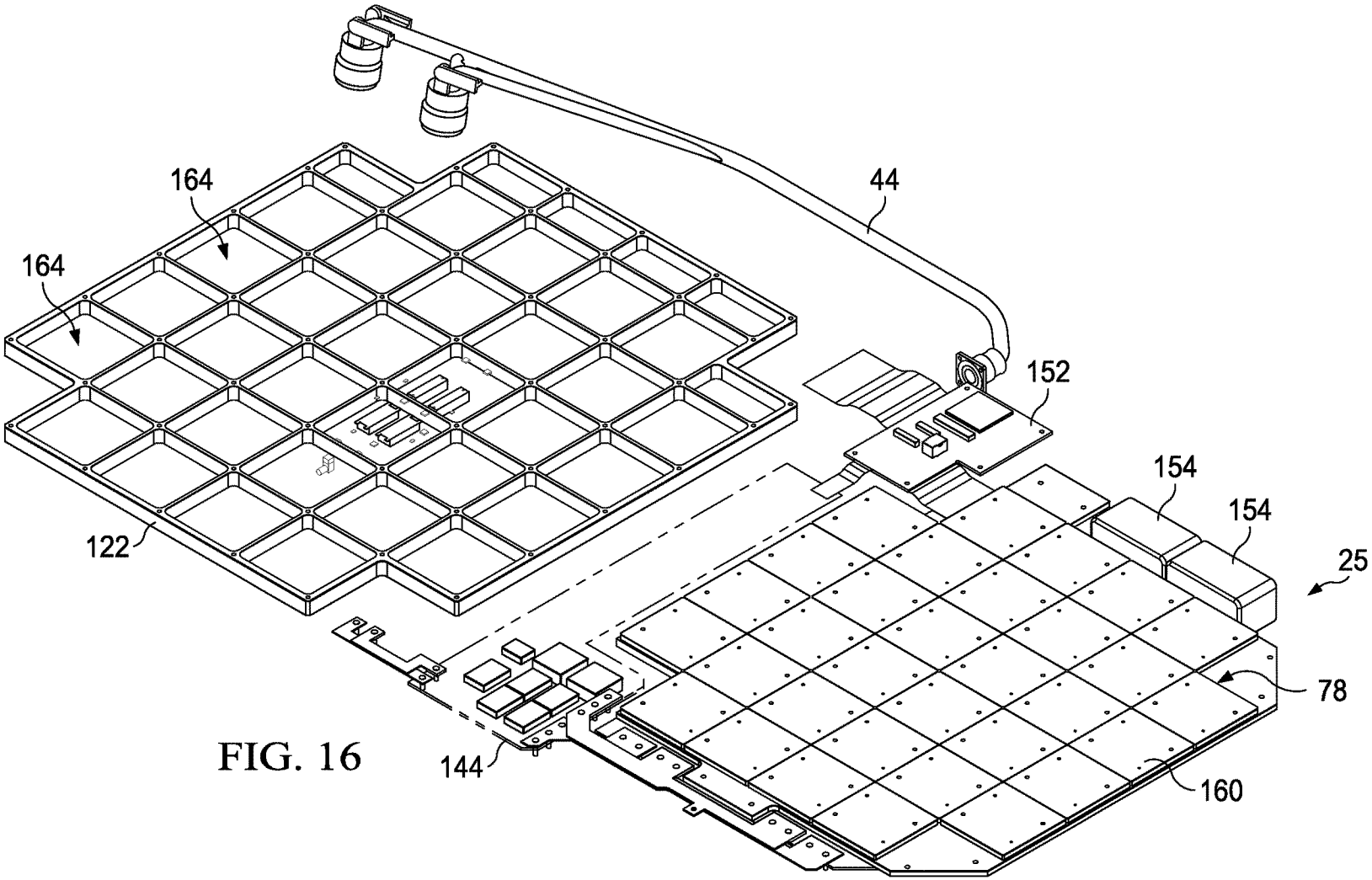
FIG. 16 is an illustration similar to FIG. 16, but wherein the printed wiring board has been removed to reveal an underlying RF isolation plate.

In FIG. 15, the receive tiles 156 and an underlying alignment and cold plate 118 have been removed to better illustrate the array of fasteners 176 and alignment pins 174. The alignment pins 174 maintain alignment between the receive tiles 156, the alignment and cold plate 118, the printed wiring board 120 and the circular waveguide holes 132 (FIG. 3) in the aperture plate 114. The fasteners 176 attach the subassembly of the receive tiles 156, the alignment and cold plate 118 and the printed wiring board 120 the bottom of the aperture plate 114. FIG. 15 also illustrates the array of interconnect elements 162 which connect each of the receive tiles 156 with circuitry on the printed wiring board 120. In FIG. 16, the printed wiring board 120 has also been removed to show the stiffening plate 122 which has an egg crate-like construction, having a plurality of integral stiffening pockets 164 that respectively overlie sections of the bottom of the printed wiring board 120 that contain the RF up and down converter circuits, thereby providing RF isolation of these circuits to prevent crosstalk or RF leakage.

Figure 17:
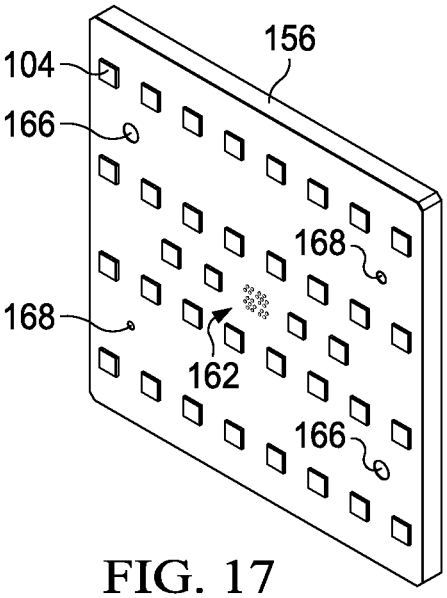
FIG. 17 is an illustration of a perspective view of the bottom side of one of the receive tiles.
Figure 18:
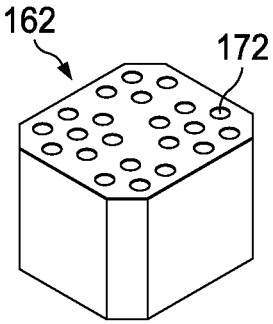
FIG. 18 is an illustration of a perspective view of one of the interconnect elements.
Figure 19:
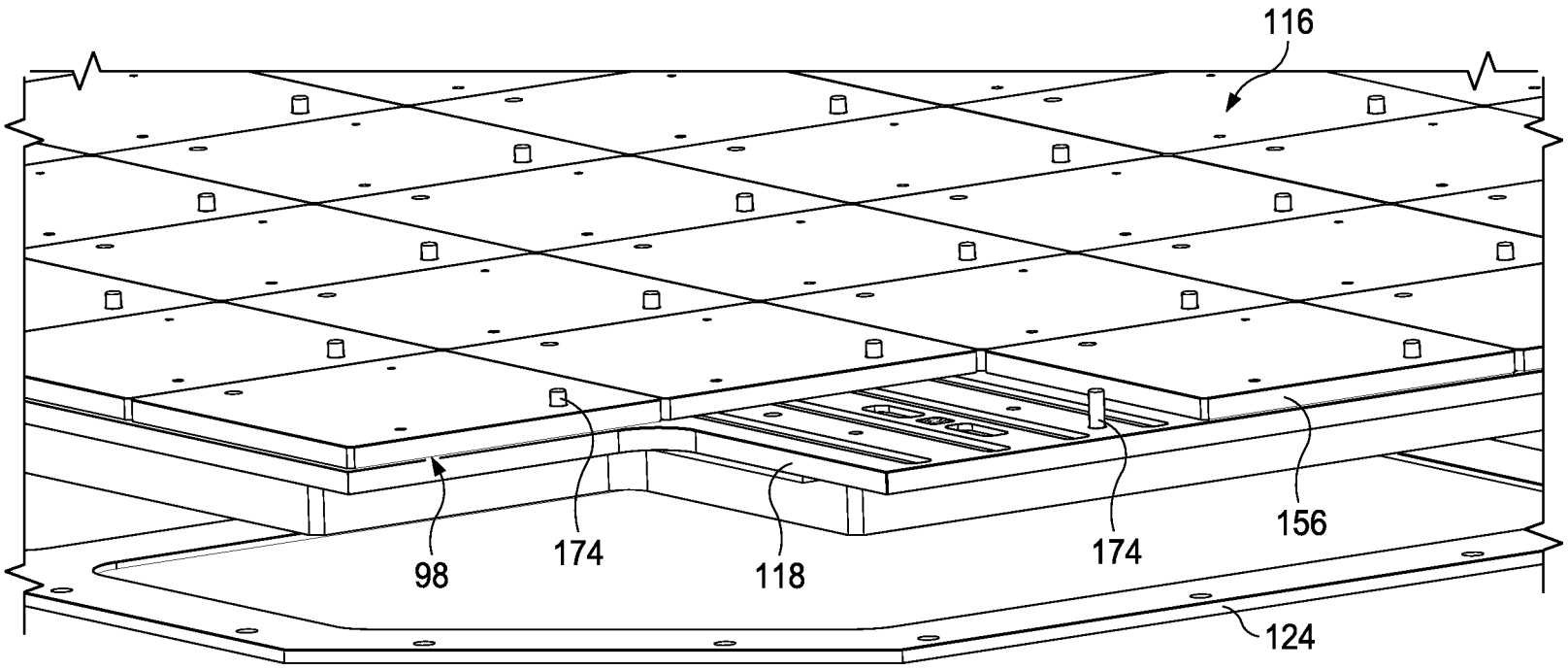
FIG. 19 is an illustration of a fragmentary, top perspective view showing layers of the receive antenna, wherein one of the tiles is removed to reveal the underlying alignment and cold plate, and alignment pins.
Figure 20:
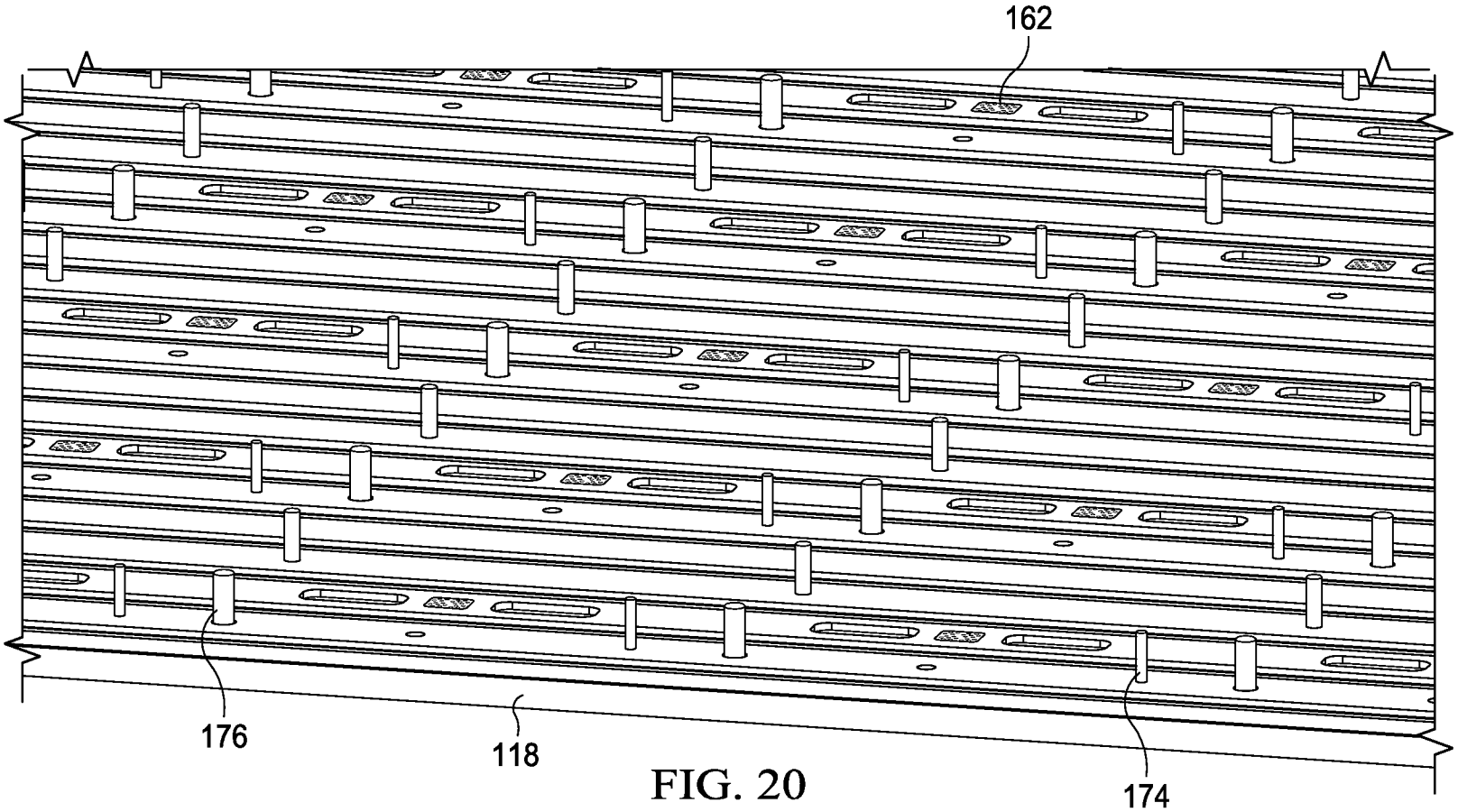
FIG. 20 is an illustration of a top perspective view of the alignment and cold plate shown in FIG. 19, better illustrating the position of the alignment pins and interconnect elements.
Figure 21:
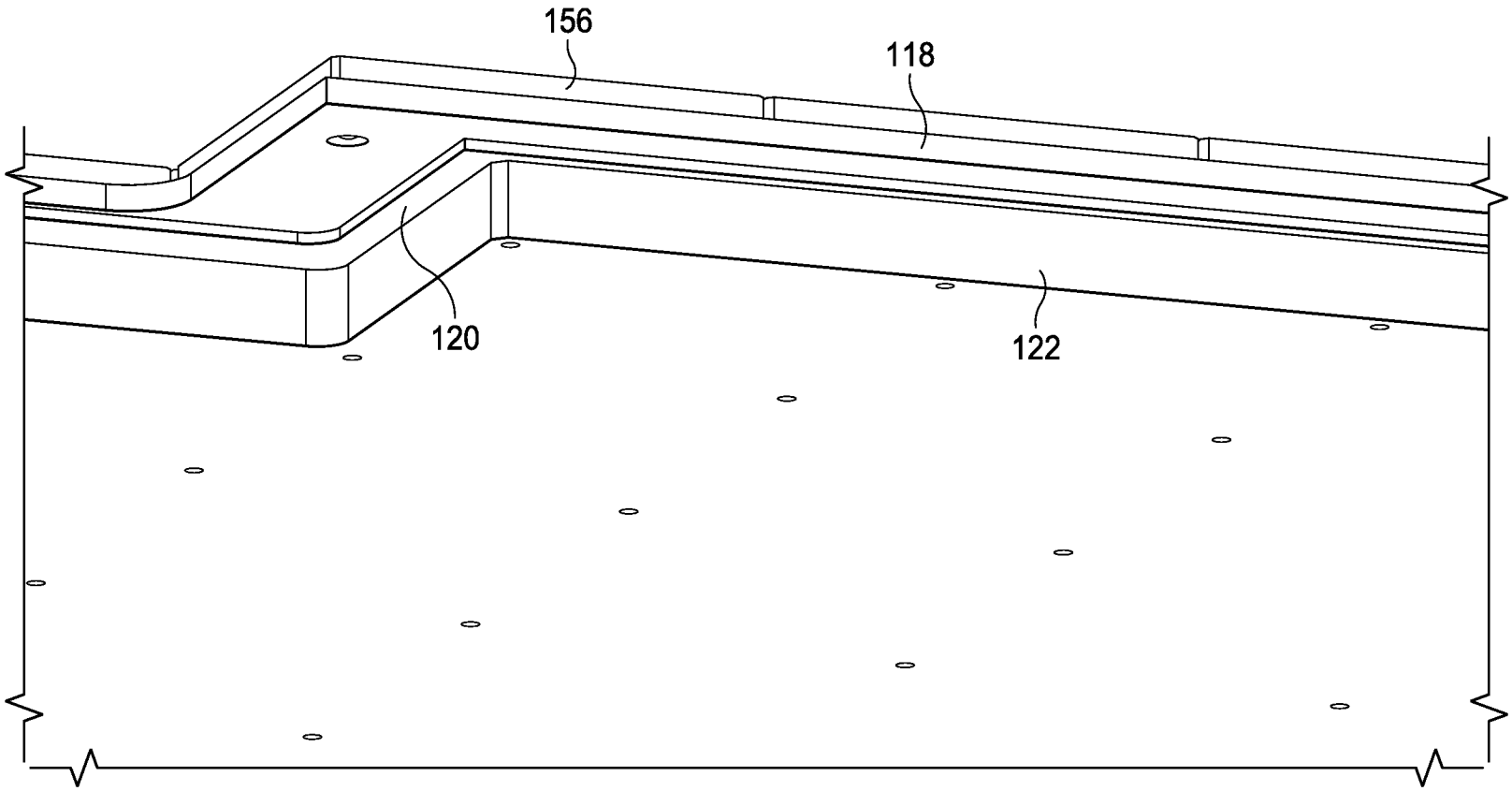
FIG. 21 is an illustration of a bottom perspective view of the receive antenna, wherein the chassis and bottom cover plate are not shown for clarity.
Figure 22:
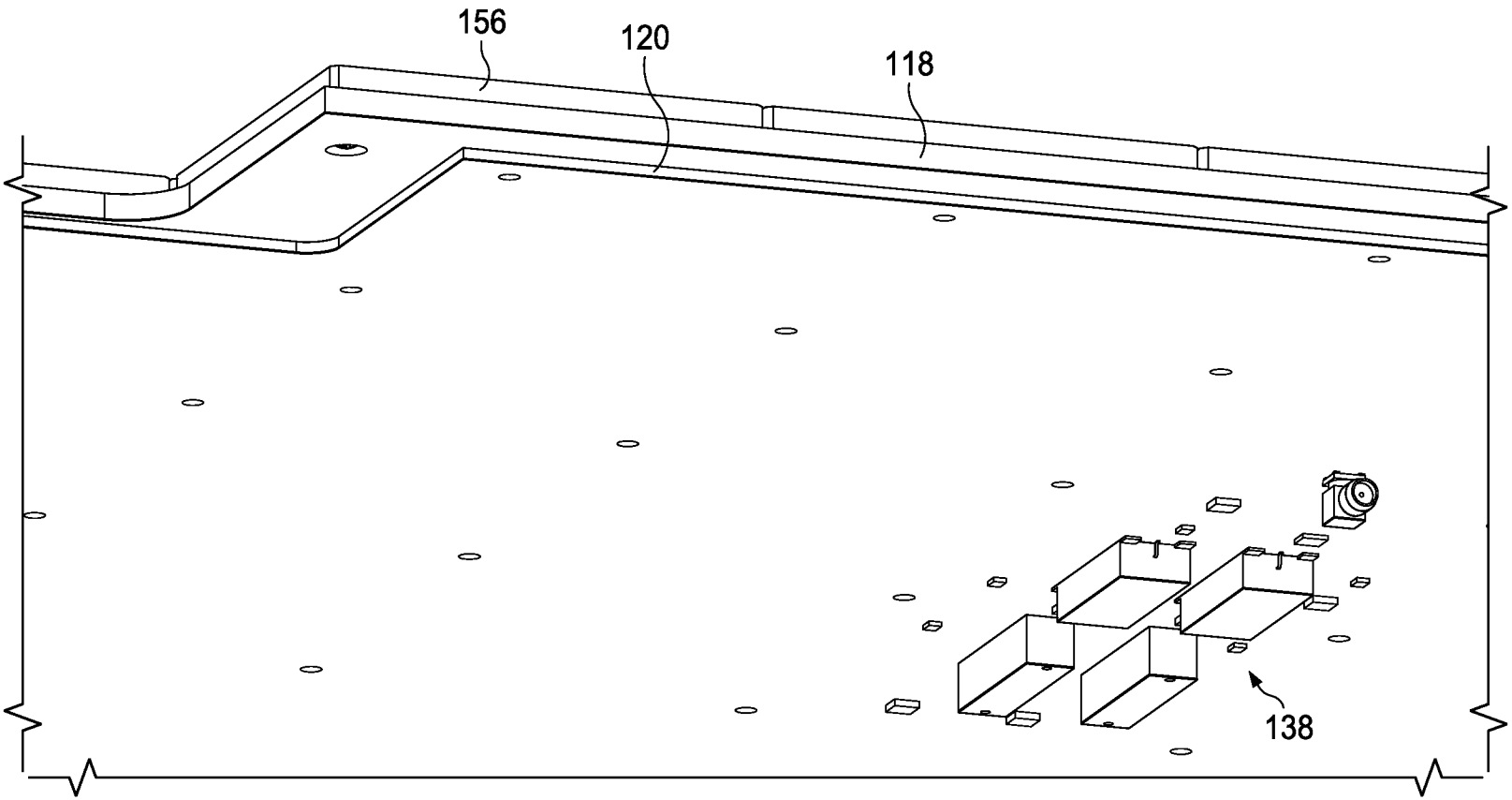
FIG. 22 is an illustration of a bottom perspective view, similar to FIG. 21, but with the RF isolation plate removed to reveal the printed wiring assembly.

FIG. 17 illustrates one of the receive tiles 156 which comprises a printed wiring assembly, including a circuit board, having a sub-array of 64 phased array electronic elements or dies 104, comprising 32 electronic elements on each side of the tile 156. Behind each of the elements 104 is an amplifier, a phase and amplitude control device (all not shown) and circuitry which implement the sub-array combiner 106 (FIG. 7). The circuitry on each the tiles 156 combines the signals from the individual electronic elements 104 into a single signal that is passed through the alignment and cold plate to circuitry on the printed wiring board 120 (FIG. 9). The backside of the elements 104 (as viewed in FIG. 17) on the tile 156 contain integrated antenna elements. The tile 156 includes a pair of alignment holes 168 for receiving the alignment pins 174, as well as a pair of fastener holes 166 for receiving the fasteners 176. Referring now also to FIG. 18, the previously mentioned interconnect elements 162 pass through each of the tiles 156 and include a plurality of spring connections 172 which provide electrical connections between the circuits on the tile 156 and the circuits contained on the underlying printed wiring board 120.

Attention is now directed to FIGS. 19-22 which better illustrate several of the physical layers of the receive antenna 35, and particularly the fasteners 176 and alignment pins 174 that both align and fasten the layers together. The fasteners 176 pass through the alignment and cold plate 118, the printed wiring board 120 and each of the tiles 156, and fasten these layers to the underside of the corresponding receive aperture plate 114. Similarly, the alignment pins 174 pass through the alignment and cold plate 118 and each of the receive tiles 156 to hold the tiles 156 in a geometric pattern such that the antenna elements of the tiles 156 are aligned with the circular waveguide holes 132 (FIG. 3) in the receive aperture plate 114.

Figure 23:
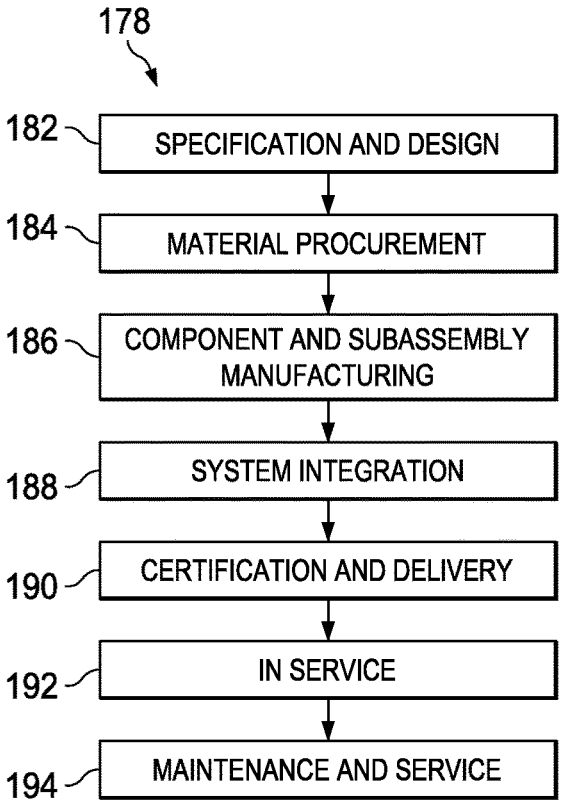
FIG. 23 is an illustration of a flow diagram of aircraft production and service methodology.
Figure 24:
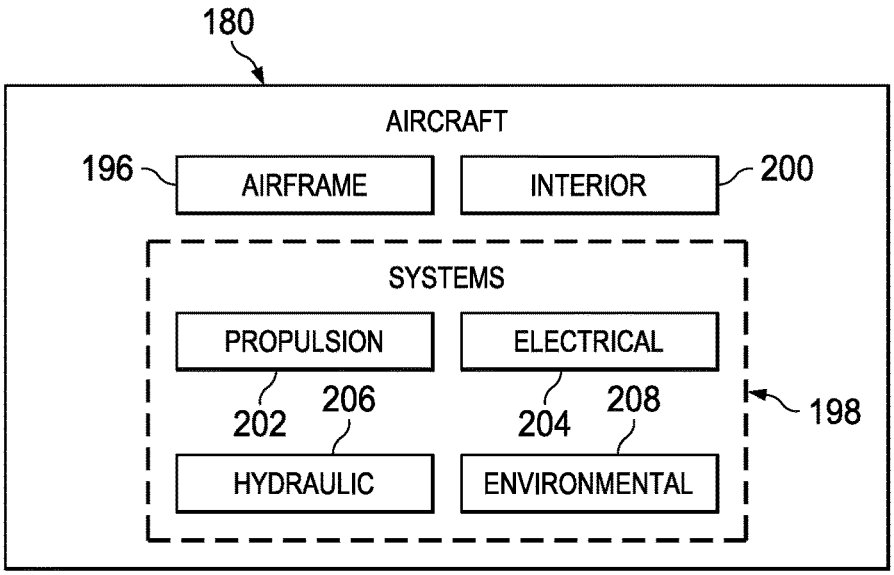
FIG. 24 is an illustration of a block diagram of an aircraft.

Embodiments of the disclosure may find use in a variety of potential applications, particularly in the transportation industry, including for example, aerospace, marine, automotive applications and other mobile platform applications where electronically steered antennas may be used. Thus, referring now to FIGS. 23 and 24, embodiments of the disclosure may be used in the context of an aircraft manufacturing and service method 178 as shown in FIG. 23 and an aircraft 180 as shown in FIG. 24. Aircraft applications of the disclosed embodiments may include, for example, without limitation, electronically steerable antennas for satellite communications. During pre-production, exemplary method 178 may include specification and design 182 of the aircraft 180 and material procurement 184. During production, component and subassembly manufacturing 186 and system integration 188 of the aircraft 180 takes place. Thereafter, the aircraft 180 may go through certification and delivery 190 in order to be placed in service 192. While in service by a customer, the aircraft 180 is scheduled for routine maintenance and service 194, which may also include modification, reconfiguration, refurbishment, and so on.

Each of the processes of method 178 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 24, the aircraft 180 produced by exemplary method 178 may include an airframe 196 with a plurality of systems 198 and an interior 200. Examples of high-level systems 198 include one or more of a propulsion system 202, an electrical system 204, a hydraulic system 206 and an environmental system 208. Any number of other systems may be included. Although an aerospace example is shown, the principles of the disclosure may be applied to other industries, such as the marine and automotive industries.

Systems and methods embodied herein may be employed during any one or more of the stages of the production and service method 178. For example, components or subassemblies corresponding to production process 186 may be fabricated or manufactured in a manner similar to components or subassemblies produced while the aircraft 180 is in service. Also, one or more apparatus embodiments, method embodiments, or a combination thereof may be utilized during the production stages 186 and 188, for example, by substantially expediting assembly of or reducing the cost of an aircraft 180. Similarly, one or more of apparatus embodiments, method embodiments, or a combination thereof may be utilized while the aircraft 180 is in service, for example and without limitation, to maintenance and service 194.

As used herein, the phrase "at least one of", when used with a list of items, means different combinations of one or more of the listed items may be used and only one of each item in the list may be needed. For example, "at least one of item A, item B, and item C" may include, without limitation, item A, item A and item B, or item B. This example also may include item A, item B, and item C or item B and item C. The item may be a particular object, thing, or a category. In other words, at least one of means any combination items and number of items may be used from the list but not all of the items in the list are required.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A phased array antenna system for a mobile platform, comprising:

an antenna enclosure adapted to be mounted on the mobile platform;

a phased array transmit antenna mounted within the antenna enclosure;

a phased array receive antenna mounted within the antenna enclosure and adjacent the phased array transmit antenna;

spaced apart partition walls within the antenna enclosure defining a space between the phased array transmit antenna and the phased array receive antenna, the spaced apart partition walls being formed of a material providing an RF barrier; and an electrical power supply within the antenna enclosure and located in the space between the spaced apart partition walls.

2. The phased array antenna system of claim 1, wherein the phased array transmit antenna is in close proximity to the phased array receive antenna.

3. The phased array antenna system of claim 2, wherein the phased array transmit antenna and the phased array receive antenna are substantially aligned along a longitudinal axis of the mobile platform.

4. The phased array antenna system of claim 1, further comprising:

antenna controller located in the space between the spaced apart partition walls and operative to control the phased array transmit antenna and the phased array receive antenna.

5. The phased array antenna system of claim 1, wherein:

the phased array transmit antenna includes a transmit aperture;

the phased array receive antenna includes a receive aperture, and the antenna enclosure includes an adapter plate adapted to be attached to the mobile platform; and a fairing covering the adapter plate and having an opening therein surrounding the transmit aperture and the receive aperture.

6. The phased array antenna system of claim 1, wherein the antenna enclosure includes an integral transmit aperture plate, and an integral receive aperture plate.

7. The phased array antenna system of claim 6, wherein the antenna enclosure includes an outer face having a set of grooves between the integral transmit aperture plate and the integral receive aperture plate providing RF isolation of the phased array receive antenna from the phased array transmit antenna.

8. The phased array antenna system of claim 7, wherein the set of grooves contain a dielectric material.

9. The phased array antenna system of claim 6, wherein each of a plurality of phased array transmit antennas and a plurality of phased array receive antennas includes:

a layer of tiles arranged as an array, wherein each tile includes an array of antenna elements;

a printed wiring board coupled with the tiles including an antenna beam former; and a plate sandwiched between the layer of tiles and the printed wiring board for drawing heat away from the tiles and the printed wiring board and for aligning the tiles with a corresponding one of the integral transmit aperture plate and an integral receive aperture plate.

10. The phased array antenna system of claim 9, wherein each of the integral transmit aperture plate and the integral receive aperture plate includes an array of waveguide holes respectively aligned with the array of antenna elements.

11. A phased array antenna system, comprising:

an antenna enclosure;

an array of waveguides in the antenna enclosure;

an array of printed wiring assemblies arranged in a layer, each printed wiring assembly in the array containing a plurality of antenna elements respectively aligned with the waveguides;

a printed wiring board coupled with the array of printed wiring assemblies and including on array distribution assembly having an electric signal converter;

a plate sandwiched between the array of printed wiring assemblies and the printed wiring board; and a plurality of alignment pins passing through the plate, the printed wiring board and each of the printed wiring assemblies for aligning the antenna elements with the array of waveguides.

12. The phased array antenna system of claim 11, wherein:

the antenna enclosure includes an integral aperture plate; and the array of waveguides are formed in the integral aperture plate.

13. The phased array antenna system of claim 12, further comprising:

fasteners attached to the plate and passing through the printed wiring board and each of the printed wiring assemblies for attaching the plate, the printed wiring board and each of printed wiring assemblies to the integral aperture plate.

14. The phased array antenna system of claim 11, further comprising:

a power supply inside the antenna enclosure and coupled with the printed wiring board; and an antenna controller located inside the antenna enclosure and coupled with the printed wiring board.

15. A low-profile, phased array antenna system, comprising:

an antenna enclosure;

a steerable beam transmit antenna in the antenna enclosure, the steerable beam transmit antenna including:

a transmit aperture through which radio frequency signals may be transmitted;

a transmit sub-array tile assembly including a plurality of transmit tiles each having a plurality of transmit antenna elements for transmitting radio frequency signals; and a transmit distribution assembly for delivering radio frequency signals to the transmit sub-array tile assembly; and a steerable beam receive antenna in the antenna enclosure, the steerable beam receive antenna including:

a receive aperture through which radio frequency signals may be received;

a receive sub-array tile assembly including a plurality of receive tiles each having a plurality of receive antenna elements for receiving radio frequency signals; and a receive array distribution assembly for converting the radio frequency signals received by the receive antenna elements to intermediate frequencies.

16. The low-profile, phased array antenna system of claim 15, wherein:

the transmit tiles are arranged in an array;

the transmit distribution assembly is arranged as a layer beneath the transmit tiles;

the receive tiles are arranged in an array; and the receive array distribution assembly is arranged as a layer beneath the receive tiles.

17. The low profile, phased array antenna system of claim 16, further comprising:

a first alignment and cold plate sandwiched between the transmit tiles and the transmit distribution assembly for drawing heat away from the transmit tiles and the transmit distribution assembly, and for aligning the transmit tiles with the transmit aperture; and a second alignment and cold plate sandwiched between the receive tiles and the receive array distribution assembly for drawing heat away from the receive tiles and the receive distribution assembly, and for aligning the receive tiles with the receive aperture.

18. The low profile, phased array antenna system of claim 15, further comprising:

a power supply coupled with the transmit distribution assembly and the receive array distribution assembly; and an antenna controller for controlling the steerable beam transmit antenna and the steerable beam receive antenna.

19. The low-profile, phased array antenna system of claim 18, wherein:

the power supply and the antenna controller are located between the steerable beam transmit antenna and the steerable beam receive antenna; and the antenna enclosure includes partition walls providing radio frequency isolation of the power supply and the antenna controller from the steerable beam transmit antenna and the steerable beam receive antenna.

* * * * *